US006142613A

United States Patent [19]

Asakawa et al.

[11] Patent Number: 6,142,613

[45] Date of Patent: Nov. 7, 2000

[54] LIQUID DISCHARGING HEAD

[75] Inventors: Yoshie Asakawa, Matsumoto; Toshio Kashino, Chigasaki; Takeshi Okazaki, Sagamihara; Aya Yoshihira; Kiyomitsu Kudo, both of Yokohama, all of Japan

[73] Assignee: Canon Kabushiki Kaisha, Tokyo, Japan

[21] Appl. No.: 09/371,538

[22] Filed: Aug. 10, 1999

Related U.S. Application Data

[62] Division of application No. 08/717,350, Sep. 20, 1996, Pat. No. 6,003,978.

[30] Foreign Application Priority Data

Sep. 22, 1995 [JP] Japan ..... 7-244987
Jun. 7, 1996 [JP] Japan ..... 8-146268

[51] Int. Cl.[7] ..... B41J 2/05
[52] U.S. Cl. ..... 347/65
[58] Field of Search ..... 347/65, 63, 94

[56] References Cited

U.S. PATENT DOCUMENTS

| | | | |
|---|---|---|---|
| 4,330,787 | 5/1982 | Sato | 347/63 |
| 4,380,771 | 4/1983 | Takatori . | |
| 4,480,259 | 10/1984 | Kruger et al. . | |
| 4,723,129 | 2/1988 | Endo et al. . | |
| 4,723,136 | 2/1988 | Suzumura | 347/65 |
| 5,278,585 | 1/1994 | Karz et al. | 347/65 |

FOREIGN PATENT DOCUMENTS

| | | | |
|---|---|---|---|
| 0 436 047 A1 | 7/1991 | European Pat. Off. | B41J 2/055 |
| 0 443 798 A2 | 8/1991 | European Pat. Off. . | |
| 55-81172 | 6/1980 | Japan . | |
| 55-100169 | 7/1980 | Japan | B41J 3/04 |
| 61-69467 | 4/1986 | Japan . | |
| 63-199972 | 8/1988 | Japan | B41J 3/04 |
| 5-104719 | 4/1993 | Japan | B41J 2/05 |

OTHER PUBLICATIONS

Patent Abstracts of Japan, vol. 015, No. 008 (M–1067), Jan. 9, 1991 (with respect to JP 2–258263 of Oct. 19, 1990).
Patent Abstracts of Japan, vol. 017, No. 679 (M–1527), Dec. 14, 1993 (with respect to JP 5–229122 of Sep. 7, 1993).

*Primary Examiner*—Fred L. Braun
*Attorney, Agent, or Firm*—Fitzpatrick, Cella, Harper & Scinto

[57] ABSTRACT

A liquid discharging head having a discharge port, a liquid flow path communicating with the discharge port, a bubble generation area on the liquid flow path, and a movable member. The movable member has a free end on the discharge port side, and the free end is shiftable when a bubble is generated in the bubble generation area. The movable member has a fluid element upstream of the bubble generation area.

2 Claims, 17 Drawing Sheets

LIQUID DISCHARGING HEAD

This is a divisional application of application Ser. No. 08/717,350, filed Sep. 20, 1996, now U.S. Pat. No. 6,003,978.

BACKGROUND OF THE INVENTION

1. Field of the Invention

This invention relates to a liquid discharging head for discharging desired liquid by the creation of air bubbles created by heat energy being caused to act on liquid, a head cartridge using the liquid discharging head, a liquid discharging device and a liquid discharging method. It further relates to an ink jet kit having such liquid discharging head.

The present invention particularly relates to a liquid discharging head having a movable member displaceable by the utilization of the creation of air bubbles, a head cartridge using the liquid discharging head, and a liquid discharging device.

More particularly, the present invention relates to a liquid discharging head which, in a construction using the above-described movable member, enables the stable supply of high-viscosity ink, can improve the refill of liquid creating air bubbles, can present liquid mixing during the non-driving of upper and lower liquids vertically spaced apart from each other by the movable member and can present discharged liquid from flowing into a heat generating member being driven beyond the movable member, a head cartridge using this liquid discharging head, a liquid discharging device, a liquid discharging method and a recording method.

Also, the present invention is an invention which can be applied to apparatuses such as a printer for effecting recording on a recording medium such as paper, yarn, fiber, cloth, hides, metals, plastics, glass, wood or ceramics, a copying apparatus, a facsimile apparatus having a communication system, and a word processor having a printer unit, and further an industrial recording apparatus compositely combined with various processing apparatuses.

The "recording" in the present invention means not only imparting images having meanings such as characters and figures to a recording medium, but also imparting images having no meaning such as patterns.

2. Related Background Art

There is known an ink jet recording method, i.e., a so-called bubble jet recording method, in which energy such as heat is given to ink to thereby cause a state change accompanied by a sharp volume change (creation of air bubbles) to the ink and the ink is discharged from a discharge port by an acting force based on this state change and is caused to adhere to a recording medium to thereby effect image formation. In a recording apparatus using this bubble jet recording method, as disclosed in U.S. Pat. No. 4,723,129, etc., there are generally disposed a discharge port for discharging ink, an ink flow path communicating with this discharge port, and an electro-thermal converting member as energy generating means disposed in the ink flow path for discharging the ink.

According to such a recording method, images of high dignity can be recorded at high speed and with low noise and in a head for effecting this recording method, discharge ports for discharging the ink can be disposed at high density and therefore, there are many excellent points such as recorded images of high resolution and further color images being capable of being easily obtained by a compact apparatus.

Therefore, this bubble jet recording method has been utilized in many office apparatuses such as printers, copying apparatuses and facsimile apparatuses, and further in industrial systems such as textile printing apparatuses in recent years.

As the bubble jet technique is utilized for products in many fields, the following requirements have heightened in recent years.

For example, as a study for the requirement for improved energy efficiency, mention is made of the optimization of a heat generating member such as adjusting the thickness of protective film. This technique is effective in improving the efficiency of the propagation of generated heat to liquid.

Also, in order to obtain images of high quality, there has been proposed a driving condition for providing a liquid discharging method or the like in which the discharge speed of ink is high and which can effect good ink discharge based on the stable creation of an air bubble, and there has been proposed a method in which from the viewpoints of high-speed recording, the shape of a liquid flow path is improved to provide a liquid discharging head which is high in the refill speed of discharged liquid into the liquid flow path.

Of this shape of the flow path, one as shown in FIGS. 1A and 1B of the accompanying drawings is described as flow path structure in Japanese Laid-Open Patent Application No. 63-199972, etc. The flow path structure and head manufacturing method described in this publication are inventions which pay attention to a back wave created with the creation of an air bubble (pressure travelling in a direction opposite to the direction toward a discharge port, i.e., pressure travelling toward a liquid chamber 12). This back wave is not energy travelling in the discharging direction and is therefore known as loss energy.

The invention shown in FIGS. 1A and 1B discloses a value 10 spaced apart from an air bubble creation area formed by a heat generating element 2 and located on a side opposite to discharge ports 11 with respect to the heat generating element 2.

In FIG. 1B, this value 10 is disclosed as one having an initial position like being stuck on the ceiling of a flow path 3 by a manufacturing method utilizing a plate material or the like, and hanging down into the flow path 3 with the creation of an air bubble. This invention is disclosed as one which controls a part of the above-described back wave by the value 10 to thereby suppress energy loss.

In this construction, however, it will be seen that it is not practical to liquid discharge to suppress a part of the back wave by the value 10 as will be seen if study is made of the time when an air bubble has been created in the flow path 3 holding the liquid to be discharged.

Originally, the back wave itself has no direct relation to discharge as previously described. At a point of time where this back wave has been created in the flow path 3, the pressure of the air bubble which is directly related to discharge has already made the liquid dischargeable from the flow path 3, as shown in FIG. 1B. Accordingly, it is apparent that even if a part of the back wave is suppressed, it will not greatly affect discharge.

On the other hand, in the bubble jet recording method, a heat generating member repeats heating while being in contact with ink and therefore, a deposit by the scorching of the ink is created on the surface of the heat generating member, and depending on the kind of the ink, a great deal of such deposit is created whereby the creation of air bubbles is made unstable and in some cases, it has been difficult for the good discharge of the ink to take place. Also, when the liquid to be discharged is liquid liable to be deteriorated by heat or is liquid difficult to provide bubbling sufficiently, there has been desired a method for discharging the liquid wall without changing the quality of the liquid to be discharged.

From such a point of view a method in which liquid for creating an air bubble by heat (bubbling liquid) and liquid to be discharged (discharge liquid) are made discrete from each other and the pressure by bubbling is transmitted to the discharge liquid to thereby discharge the discharge liquid is disclosed in Japanese Laid-Open Patent Application No. 61-69467, Japanese Laid-Open Patent Application No. 55-81172, U.S. Pat. No. 4,480,259, etc. In these publications, there is adopted a construction in which ink which is the discharge liquid and the bubbling liquid are completely separated from each other by flexible film such as silicone rubber so that the discharge liquid may not directly contact with a heat generating member and the pressure by the bubbling of the bubbling liquid is transmitted to the discharge liquid by the deformation of the flexible film. By such a construction, the prevention of a deposit on the surface of the heat generating member and an improvement in the degree of freedom of choice of the discharge liquid are achieved.

However, a head of the construction as previously described in which the discharge liquid and the bubbling liquid are completely separated from each other is of a construction in which the pressure during bubbling is transmitted to the discharge liquid by the expansion and contraction of the flexible film and therefore, the flexible film considerably absorbs the pressure by bubbling. Also, it is possible to obtain the effect by separating the discharge liquid and the bubbling liquid from each other because the amount of deformation of the flexible film is not very great, but there has been the possibility of energy efficiency and discharging force being reduced.

SUMMARY OF THE INVENTION

The present invention has as its task to enhance the fundamental discharge characteristic of the conventional system in which an air bubble (particularly an air bubble resulting from film boiling) are basically formed in a liquid flow path to thereby discharge liquid to a level which could not heretofore be anticipated, from a viewpoint which could not heretofore be conceived.

Some of the inventors have returned to the principles of liquid droplet discharge and have energetically studied to provide a novel liquid droplet discharging method utilizing an air bubble which has not heretofore been obtained and a head or the like for use therein. At this time, they have carried out a first technical analysis starting from the operation of a movable member in a liquid flow path such as analyzing the principle of the mechanism of the movable member in the flow path, a second technical analysis starting from the principles of liquid droplet discharge by air bubble, and a third analysis starting from the air bubble forming area of a heat generating member for air bubble formation.

By these analyses, they have come to establish an entirely novel technique for positively controlling an air bubble by bringing the arrangement relation between the fulcrum and the free end of the movable member into a relation in which the free end is situated on the discharge port side, i.e., the downstream side, and disposing the movable member in face-to-face relationship with the heat generating member or the air bubble creating area.

Next, they have come to find that when the energy an air bubble itself gives the discharge amount is taken into account, it is the greatest factor which can markedly improve the discharge characteristic to consider the growing component of the air bubble on the downstream side. That is, it has also been found that it brings an improvement in discharge efficiency and discharge speed to efficiently turn the growing component of the air bubble on the downstream side to the discharge direction. From this, the inventors have come to a very high technical level as compared with the conventional technical level that the growing component of the air bubble is positively moved to the free end side of the movable member.

It has further been found that it is also preferable to take into consideration structural elements such as the movable member and liquid flow paths concerned in the growth in a heat generating area for forming an air bubble, for example, the downstream side from the center line passing through the center of area of an electro-thermal converting member in the flow direction of liquid, or the downstream side of an air bubble such as the center of area on a surface which governs bubbling.

On the other hand, it has also been found that by taking the disposition of the movable member and the structure of liquid supply paths into consideration, the refill speed can be greatly improved.

It has further been found that by controlling the mutual pressure balance between upper and lower flow paths spaced apart from each other by the movable member, the stable supply of high-viscosity ink becomes possible and the refill of the liquid creating an air bubble can be improved and the discharge of the ink increased in viscosity can be made easy, and the mixing of the liquid for discharge and the liquid for bubbling spaced apart from each other by one movable member during non-driving can be appropriately prevented to thereby prevent the liquid for discharge from flowing onto the heat generating member being driven beyond the movable member.

The applicant has already filed an application covering the excellent principle of discharge of liquid, from the findings and general viewpoint thus obtained from the studies by some of the inventors, and the present invention has been thought out based on the inventors' more preferable idea on the premise of such principle of discharge of liquid.

The point the inventors have recognized is that "the behavior of the movable member is directly concerned in the performance of the present liquid discharging head and it is necessary to make the behavior of this movable member more reliable; for the purpose, it is important to study the conditions of the liquids at two positions spaced apart from each other by the movable member and make them controllable".

A primary object of the present invention is to provide a construction which efficiently uses a very novel principle of liquid discharge by fundamentally controlling a created air bubble, that is, which efficiently uses the expanding force of the created air bubble which provides the discharge driving force of liquid by a movable member, at the distance of an air bubble creating area and an area separate from this air bubble creating area by the movable member, and further provide this peculiar construction which (1) enables the stable supply of high-viscosity ink, (2) improves the refill of liquid creating an air bubble, (3) facilitates the discharge of ink increased in viscosity, (4) appropriately prevents the mixing of liquid for discharge and liquid for bubbling spaced apart from each other by the movable member during non-driving, and (5) appropriately prevents the liquid for discharge from flowing onto a heat generating member being driven beyond the movable member.

The typical requirements of the present invention for achieving the above-noted object are as follows.

A liquid discharging method of using a head having a first liquid flow path communicating with a discharge port, a second liquid flow path having an air bubble creating area, and a movable member having a free end on said discharge port side and disposed between said first liquid flow path and said air bubble creating area, to create an air bubble in said air bubble creating area, displace the free end of said movable member to said first liquid flow path side on the basis of pressure by the creation of said air bubble, and direct said pressure to the discharge port side of said first liquid flow path by the displacement of said movable member to thereby discharge liquid, characterized in that the internal pressure of said first liquid flow path and the internal pressure of said second liquid flow path are made to differ from each other.

On a liquid discharging head having a first liquid flow path communicating with a discharge port, a second liquid flow path having an air bubble creating area for applying heat to liquid to thereby create an air bubble in said liquid, and a movable member disposed between said first liquid flow path and said air bubble creating area, having a free end on the discharge port side, and displacing said free end to said first liquid flow path side on the basis of pressure by the creation of the air bubble in said air bubble creating area to thereby direct said pressure to the discharge port side of said first liquid flow path, characterized in that the internal pressure of said first liquid flow path and the internal pressure of said second liquid flow path differ from each other.

Or a liquid discharging head having a plurality of discharge ports for discharging liquid, a grooved member integrally having a plurality of grooves for constituting a plurality of first liquid flow paths corresponding to and directly communicating with the respective discharge ports, and a recess constituting a first common liquid chamber for supplying the liquid to said plurality of first liquid flow paths, and a separating wall provided with an element substrate having disposed thereon a plurality of heat generating members for applying heat to the liquid to thereby create an air bubble in the liquid, and a movable member disposed between said grooved member and said element substrate and constituting a portion of second liquid flow paths corresponding to said heat generating members, and displaceable to said first liquid flow path side by pressure based on the creation of said air bubble at a position facing said heat generating members, characterized in that the internal pressure of said first liquid flow paths and the internal pressure of said second liquid flow paths differ from each other.

Or a liquid discharging apparatus characterized by a liquid discharging head having a first liquid flow path communicating with a discharge port, a second liquid flow path having an air bubble creating area for applying heat to liquid to thereby create an air bubble in said liquid, and a movable member disposed between said first liquid flow path and said air bubble creating area, having a free end, and displacing said free end to said first liquid flow path side on the basis of pressure by the creation of the air bubble in said air bubble creating area to thereby direct said pressure to the discharge port side of said first liquid flow path side, and internal pressure control means for making the internal pressure of said first liquid flow path and the internal pressure of said second liquid flow path differ from each other.

Or a liquid discharging apparatus characterized by a liquid discharging head having a plurality of discharge ports for discharging liquid, a grooved member integrally having a plurality of grooves for constituting a plurality of first liquid flow paths corresponding to and directly communicating with the respective discharge ports, and a recess constituting a first common liquid chamber for supplying the liquid to said plurality of first liquid flow paths, and a separating wall provided with an element substrate having disposed thereon a plurality of heat generating members for applying heat to the liquid to thereby create an air bubble in the liquid, and a movable member disposed between said grooved member and said element substrate and constituting a portion of the walls of second liquid flow paths corresponding to said heat generating members and displaceable to said first liquid flow path side by pressure based on the creation of said air bubble at a position facing said heat generating members, and internal pressure control means for making the internal pressure of said first liquid flow paths and the internal pressure of said second liquid flow paths differ from each other.

Or a recording system having one of the aforedescribed liquid discharging apparatuses, and an after processing apparatus for pressing a recording medium after recording for the fixation of said liquid.

Or a recording system having one of the aforedescribed liquid discharging apparatuses, and a before processing apparatus for pressing a recording medium before recording for the fixation of said liquid.

Or a liquid container for use in a liquid discharging head having a first liquid flow path communicating with a discharge port, a second liquid flow path having an air bubble creating area for applying heat to liquid to thereby create an air bubble in said liquid, and a movable member disposed between said first liquid flow path and said air bubble creating area, having a free end on the discharge port side, and displacing said free end to said first liquid flow path side on the basis of pressure by the creation of the air bubble in said air bubble creating area to thereby direct said pressure to the discharge port side of said first liquid flow path, characterized by a first containing portion containing therein a first liquid to be supplied to said first liquid flow path, and a second containing portion containing therein a second liquid to be supplied to said second liquid flow path, the supply pressure of the liquid supplied from said first containing portion to said first liquid flow path and the supply pressure of the liquid supplied from said second containing portion to said second liquid flow path differing from each other.

Or a head cartridge characterized by a liquid discharging head having a first liquid flow path communicating with a discharge port, a second liquid flow path having an air bubble creating area for applying heat to liquid to thereby create an air bubble in said liquid, and a movable member disposed between said first liquid flow path and said air bubble creating area, having a free end on the discharge port side, and displacing said free end to said first liquid flow path side on the basis of pressure by the creation of the air bubble in said air bubble creating area to thereby direct said pressure to the discharge port side of said first liquid flow path, and a liquid container having a first containing portion containing therein a first liquid to be supplied to said first liquid flow path, and a second containing portion containing therein a second liquid to be supplied to said second liquid flow path, the supply pressure of the liquid supplied from said first containing portion to said first liquid flow path and the supply pressure of the liquid supplied from said second containing portion to said second liquid flow path differing from each other.

Or a liquid discharge recording method using a head having a first liquid flow path communicating with a discharge port, a second liquid flow path having an air bubble creating area, and a movable member having a free end on said discharge port side and disposed between said first liquid from path and said air bubble creating area to cause said air bubble creating area to create an air bubble, displace the free end of said movable member to said first liquid flow path on the basis of pressure by the creation of said air bubble, and direct said pressure to the discharge port side of said first liquid flow path by the displacement of said movable member to thereby discharge recording liquid, characterized in that the internal pressure of said first liquid flow path and the internal pressure of said second liquid flow path are made to differ from each other.

According to the liquid discharging method and head of the present invention based on the very novel principles of discharge as described above, the combined effect of a created air bubble and the movable member displaced thereby can be obtained and the liquid near the discharge port can be efficiently discharged and therefore, discharge efficiency can be improved as compared with the discharging method, head, etc. of the conventional bubble jet type. For example, in the most preferred form of the present invention, there could be attained a marked improvement in discharge efficiency double or higher.

According to the characteristic construction of the present invention, i.e., the construction in which the internal pressure of the first liquid flow path and the internal pressure of the second liquid flow path, the two liquid flow paths being spaced apart from each other by the movable member, are made to differ from each other, the stable supply of high-viscosity ink is made possible and the refill of the liquid creating an air bubble can be improved, and the mixing of the upper and lower liquids vertically spaced apart from each other by the movable member during non-driving can be prevented, and the discharge performance (called "first-shot stability" which means that a first liquid droplet is stably discharged without errors at the start of recording) at the start of recording can be improved and the discharged liquid can be prevented from flowing onto the heat generating members being driven beyond the movable member (as a result, it never happens that scorching is caused on the heat generating members with the lapse of time).

Also, even when the head is left under low temperature or low humidity for a long period, non-discharge can be prevented and even if non-discharge occurs, there is also the advantage that the head can be restored to its normal state on the spot simply by carrying out a recovery process such as preliminary discharge or suction recovery.

Specifically, even if the head of the present invention is left under such a condition that most of the heads of the conventional bubble jet type having sixty-four discharge ports experience non-discharge, about a half or less discharge ports only experience bad discharge in the head of the present invention. Also, when these heads are recovered by preliminary discharge, it has been necessary to effect several thousand times of preliminary discharge on each discharge port in the conventional head, but in the present invention, it has sufficed to effect recovery by only about one hundred times of preliminary discharge. This means that the recovery time can be shortened and the loss of the liquid by the recovery can be reduced and running cost can also be greatly reduced.

Also, particularly according to the construction of the present invention which is improved in refill characteristic, the responsiveness during continuous discharge, the stable growth of an air bubble and the stabilization of liquid droplets could be achieved to thereby make high-speed recording and high image quality recording by high-speed liquid discharge possible.

The other effects of the present invention will be understood from the description of each embodiment.

The "liquid supply pressure" used in the description of the present invention refers to the negative pressure, the water head pressure or the like of the liquid containing portions.

Also, the "internal pressure of the liquid flow paths" used in the description of the present invention refers to the pressure in the liquid flow paths near the movable member, and the difference in the pressure refers to the pressure difference between the first and second liquid flow paths near the movable member.

Also, the "upstream" and "downstream" used in the description of the present invention are represented as expressions with respect to the direction of flow of the liquid flowing from a liquid supply source to the discharge port via the air bubble creating area (or the movable member), or to the direction in terms of this construction.

Also, the "downstream side" regarding an air bubble itself represents chiefly the discharge port side portion of the air bubble understood as directly acting on the discharge of liquid droplets. More specifically, it means an air bubble created in an air on the downstream side with respect to the above-mentioned direction of flow or the above-mentioned direction in terms of the construction, or on the downstream side of the center of the area of the heat generating member, relative to the center of the air bubble.

Also, the "substantially hermetically sealed" used in the description of the present invention means such a degree of state in which when an air bubble grows, the air bubble does not slip out of a gap (slit) around the movable member before the movable member is displaced.

Further, the "separating wall" referred to in the present invention broadly means a wall (which may include the movable member) intervening so as to demarcate the air bubble creating area and an area directly communicating with the discharge port, and in a narrow sense, it means a wall demarcating a flow path including the air bubble creating area and the liquid flow path directly communicating with the discharge port, and preventing the mixing of the liquids in the respective areas.

DESCRIPTION OF THE PREFERRED EMBODIMENTS (Embodiment 1)

A first embodiment of the present invention will hereinafter be described with reference to the drawings.

In this embodiment, the liquid flow path is made into a double flow construction and further, heat is applied to liquid, whereby a liquid to be caused to bubble (bubbling liquid) and a liquid chiefly to be discharged (discharge liquid) can be separated from each other.

Figure 1A:
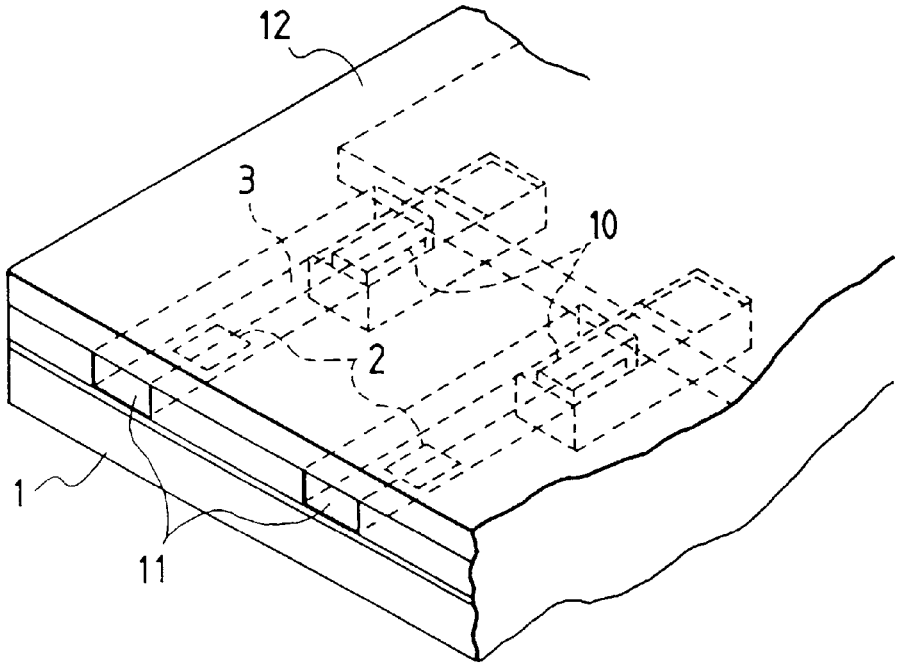
PRIOR ART FIG. 1A
FIGS. 1A and 1B are schematic views for illustrating a liquid discharging head according to the prior art.
Figure 1B:
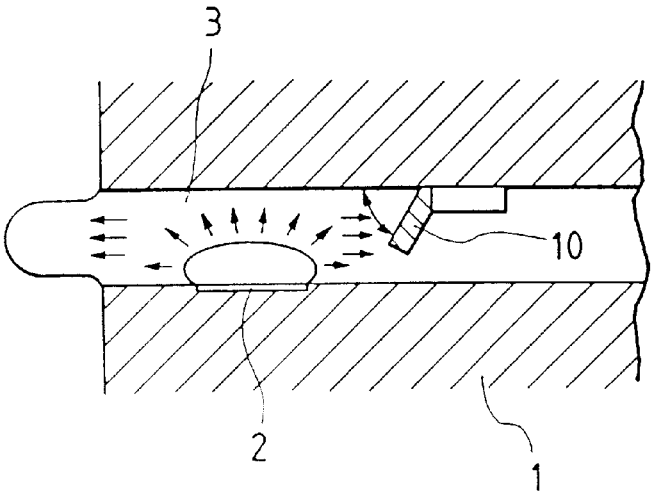
PRIOR ART FIG. 1B
Figure 2:
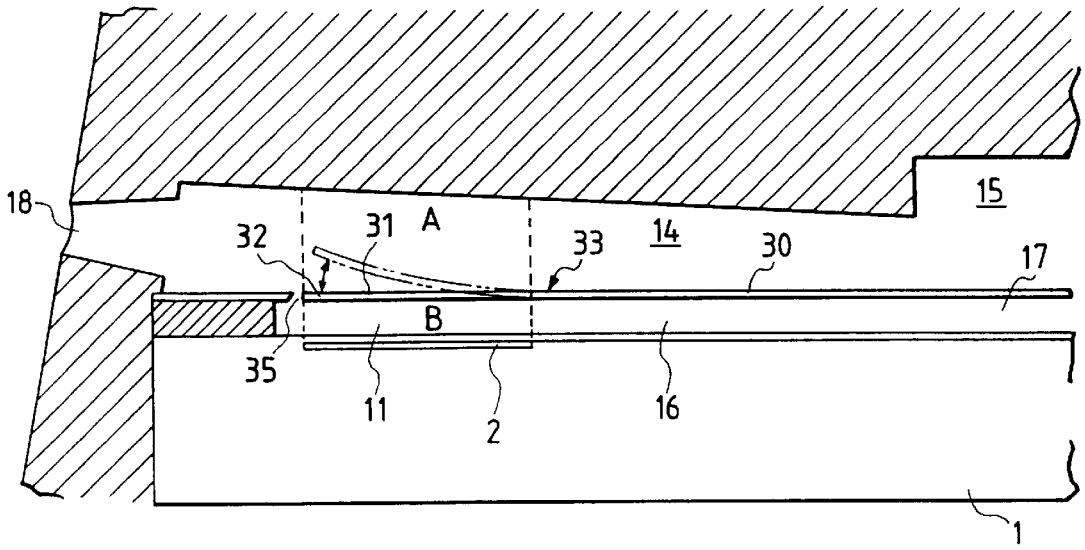
FIG. 2 is a schematic cross-sectional view showing an example of a liquid discharging head applied to the present invention.
Figure 3:
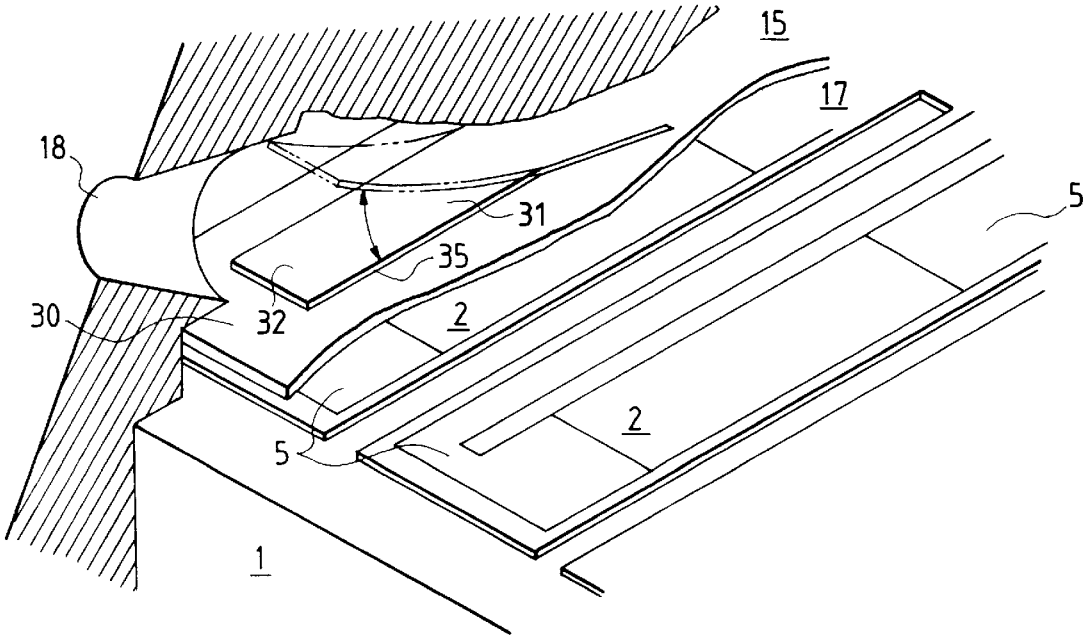
FIG. 3 is a partly broken-away perspective view of the liquid discharging head applied to the present invention.

FIG. 2 is a schematic cross-sectional view of a liquid discharging head applied to the present invention in the direction of the flow paths thereof, and FIG. 3 is a partly broken-away perspective view of this liquid discharging head.

This liquid discharging head has second liquid flow paths 16 for bubbling on an element substrate 1 having provided thereon a heat generating member 2 for giving the liquid heat energy for creating an air bubble in the liquid, and first liquid flow paths 14 for discharge liquid directly communicating with a discharge port 18 and disposed on the second liquid flow path.

The upstream side of the first liquid flow paths 14 communicates with a first common liquid chamber 15 for supplying the discharge liquid to the plurality of first liquid flow paths 14, and the upstream side of the second liquid flow paths 16 communicates with a second common liquid chamber 17 for supplying the bubbling liquid to the plurality of second liquid flow paths 16.

Between the first and second liquid flow paths 14 and 16, there is disposed a separating wall 30 formed of a resilient material such as a metal, and it separates the first liquid flow paths 14 and the second liquid flow paths 16 from each other. In the case of a liquid for which it is described as much as possible that the bubbling liquid and the discharge liquid do not mix with each other, it is preferable that the flows of the liquid in the first liquid flow paths 14 and the second liquid flow paths 16 be separated from each other as completely as possible by this separating wall 30, but when there is no problem even if the bubbling liquid and the discharge liquid mix with each other to a certain degree, or when the bubbling liquid and the discharge liquid are the same liquid, the separating wall 30 need not be given the completely separating function.

That portion of the separating wall 30 which is situated in the upward projection space (hereinafter referred to as the discharge pressure creating area: an area A and an air bubble creating area 11 in FIG. 2) in the direction of the surface of the heat generating member 2 provides a free end 32 on the discharge port side (the downstream side of the flow of the liquid) by a slit 35, and provides a movable member 31 of which the fulcrum 33 is situated on the common liquid chamber (15, 17) side. This movable member 31 is disposed in face-to-face relationship with the air bubble creating area 11(B) and therefore moves so as to be opened toward the discharge port 18 side of the first liquid flow path 18 side by the bubbling of the bubbling liquid (the direction of arrow in FIG. 2). Also in FIG. 3, the separating wall 30 is disposed on the element substrate 1 having disposed thereon a heat generating resistance portion as the heat generating member 2 and a wiring electrode 5 for applying an electrical signal to this heat generating resistance portion, through a space constituting the second liquid flow paths.

The operation of the liquid discharging head applied to the present invention will now be described with reference to FIGS. 4 and 5.

For operating the head, the head was operated by the use of inks of the same wafer origin as the discharge liquid supplied to the first liquid flow paths 14 and the bubbling liquid supplied to the second liquid flow paths 16.

Heat generated by the heat generating member 2 acts on the bubbling liquid in the air bubble creating area of the second liquid flow paths to thereby create in the bubbling liquid an air bubble 40 based on the film boiling phenomenon as described in U.S. Pat. No. 4,723,129.

Figure 4:
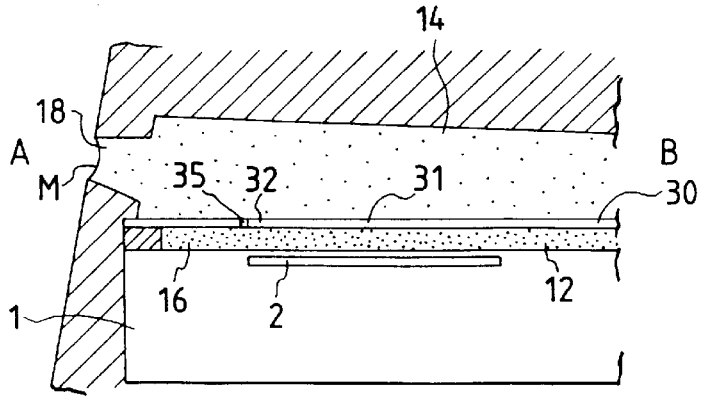
FIG. 4 is a schematic cross-sectional view showing the operation of the head applied to the present invention.
Figure 5:
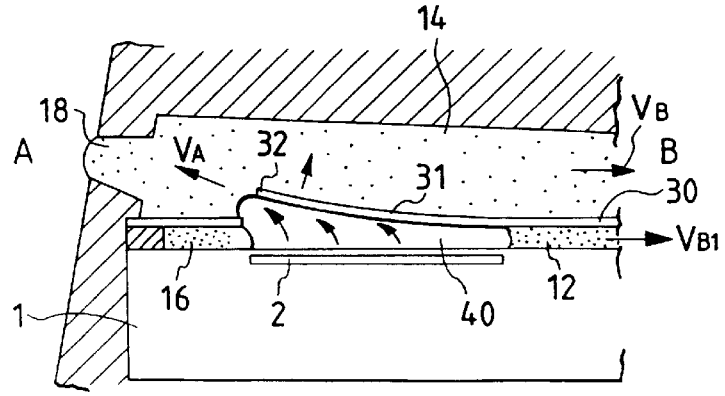
FIG. 5 is a schematic cross-sectional view showing the operation of the head applied to the present invention.
Figure 6:
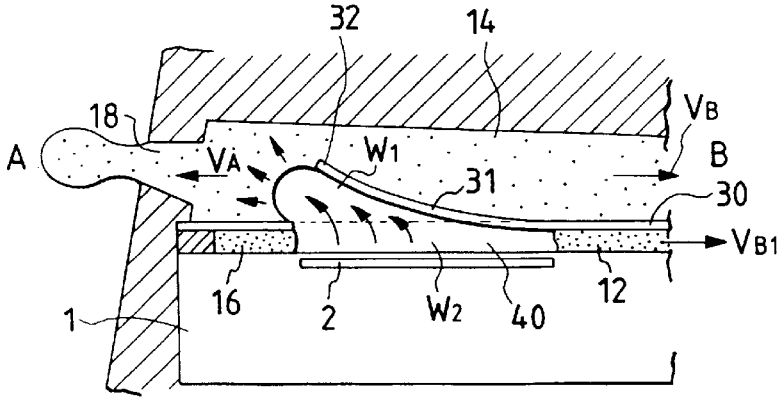
FIG. 6 is a schematic cross-sectional view showing the operation of the head applied to the present invention.

In the example applied to the present invention, there is not the escape of bubbling pressure from three directions except the upstream side of the air bubble creating area 11 and therefore, the pressure resulting from the creation of this air bubble concentrated propagates to the movable member 31 side disposed in the discharge pressure creating portion, and with the growth of the air bubble, the movable member 31 is displaced from the state of FIG. 4 to the first liquid flow path 14 side, as shown in FIG. 5. By this movement of the movable member 31, the first liquid flow paths 14 and the second liquid flow paths 16 greatly communicate with each other, and the pressure based on the creation of the air bubble propagates chiefly in the direction (direction A) toward the discharge port 18 side of the first liquid flow paths 14. When the air bubble 40 grows further as shown in FIG. 6, the liquid is discharged from the discharge port 18 by the propagation of the pressure thereof and the mechanical displacement of the movable member 31.

Subsequently, as the air bubble 40 contracts, the movable member 31 returns to the position of FIG. 7 through the state of FIG. 6 and an amount of discharge liquid corresponding to the amount of discharge liquid discharged by the first liquid flow paths 14 is supplied from the upstream side. This supply of the discharge liquid does not hamper the refill of the discharge liquid by the movable member 31 because the movable member 31 is in a direction to close.

One of the basic principles of discharge of the present invention will now be described. The most important one of the basic principles applied to the present invention is that the movable member 31 disposed so as to face the air bubble is displaced from a first position which is a steady state to a second position which is the position after displacement on the basis of the pressure of the air bubble or the air bubble itself, and the pressure resulting from the creation of the air bubble or the air bubble itself is directed to the downstream side on which the discharge port 18 is disposed, by this displaced movable member 31.

Figure 8:
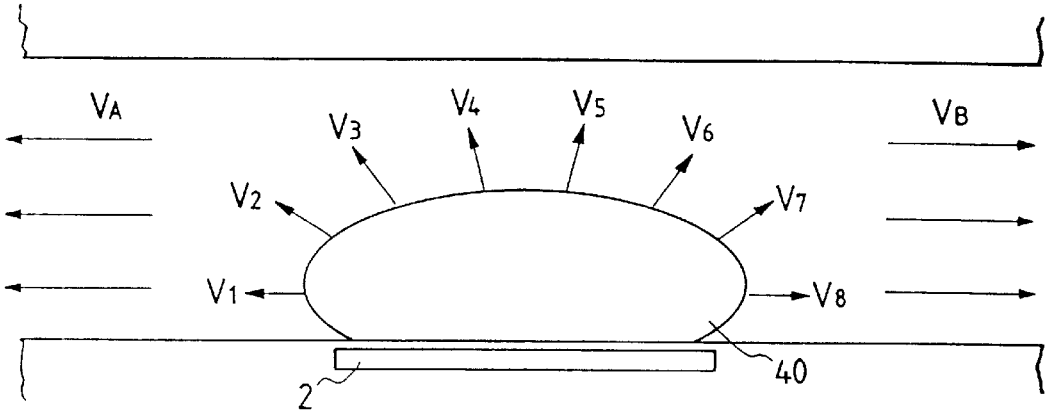
PRIOR ART FIG. 8
FIG. 8 is a schematic view showing the propagation of pressure from an air bubble in the head according to the prior art.
Figure 9:
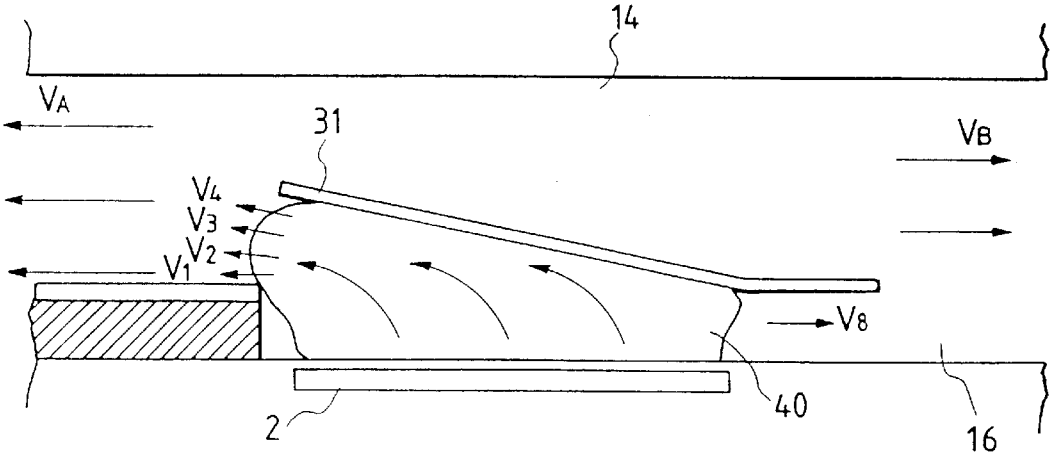
FIG. 9 is a schematic view showing the propagation of pressure from an air bubble in the head applied to the present invention.

This principle will hereinafter be described in greater detail by comparing FIG. 8 showing the prior-art liquid flow path structure which does not use the movable member with FIG. 9 showing the present invention. Here, the direction of propagation of the pressure toward the discharge port is indicated as $V_A$, and the direction of propagation of the pressure toward the upstream side is indicated as $V_B$.

In the prior-art head as shown in FIG. 8, there is no construction for regulating the direction of propagation of the pressure by the created air bubble 40. Therefore, the direction of propagation of the pressure by the air bubble 40 has been perpendicular to the surface of the air bubble and varies as indicated by arrows $V_1$ to $V_8$. Among these, particularly the pressures having the components of the direction of propagation of the pressure in the direction $V_A$ which most affect the discharge of the liquid are $V_1$ to $V_4$, i.e., direction components of pressure propagation in those portions of the air bubble which are nearer to the discharge port than the position of about a half of the air bubble, and are important portions which directly contribute to liquid discharge efficiency, liquid discharging force, discharge speed, etc. Further, $V_1$ is nearest to the discharge direction $V_A$ and therefore works efficiently, and conversely $V_4$ is relatively small in the direction component toward $V_A$.

Figure 7:
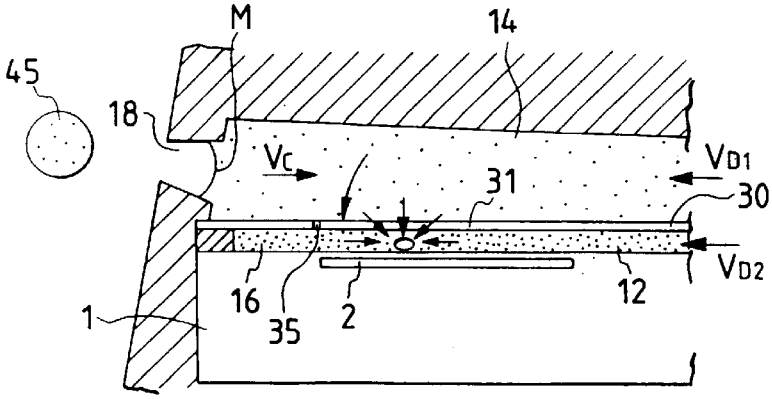
FIG. 7 is a schematic cross-sectional view showing the operation of the head applied to the present invention.

In contrast, in the case of the present invention shown in FIG. 9, the movable member 31 turns the directions of propagation $V_1$ to $V_4$ of the pressure of the air bubble having so far faced in various directions as in the case of FIG. 7 to the downstream side (the discharge port side) and to the direction of propagation $V_A$ of the pressure, whereby the pressure of the air bubble 40 efficiently contributes directly to the discharge. The direction of growth itself of the air bubble is turned to the downstream direction like the directions of propagation $V_1$ to $V_4$ of the pressure, and the air bubble grows greater downstream than upstream. The direction of growth itself of the air bubble is thus controlled by the movable member to thereby control the direction of propagation of the pressure of the air bubble, whereby a fundamental improvement in discharge efficiency, discharging force, discharge speed, etc. can be achieved.

Turning back to FIGS. 4 to 7, the discharging operation of the liquid discharging head applied to the present invention will now be described in detail.

FIG. 4 shows the state before energy such as electrical energy is applied to the heat generating member 2, that is, the state before the heat generating member 2 generates heat.

FIG. 5 shows a state in which electrical energy or the like has been applied to the heat generating member 2 and the heat generating member 2 has generated heat and a portion of the liquid filling the air bubble creating area 11 has been heated by the generated heat, whereby an air bubble 40 resulting from film boiling has been created.

At this time, the movable member 31 is displaced from the first position to the second position by the pressure based on the creation of the air bubble 40 so as to turn the direction of propagation of the pressure of the air bubble 40 toward the discharge port. What is important here is that as previously described, the free end of the movable member 31 is disposed on the downstream side (the discharge port side) and the fulcrum 33 is disposed so as to be situated on the upstream side (the common liquid chamber side) and at least a portion of the movable member 31 is made to face the downstream portion of the heat generating member 2, i.e., the downstream portion of the air bubble.

FIG. 6 shows a state in which the air bubble 40 has further grown and the movable member 31 has been further displaced in conformity with the pressure resulting from the creation of the air bubble 40. The created air bubble 40 has grown more greatly in the downstream than in the upstream and has grown greatly beyond the first position (the dotted-line position) of the movable member 31. The movable member 31 is thus gradually displaced in conformity with the growth of the air bubble 40, whereby the direction of propagation of the pressure of the air bubble 40 or the direction in which the movement of deposition is easy, i.e., the direction of growth of the air bubble 40 toward the free end 32 side, can be uniformly turned to the discharge port 18, and this also is considered to enhance discharge efficiency. The movable member 31 hardly hinders the propagation of the air bubble 40 and its bubbling pressure when they are directed toward the discharge port 18, and the direction of propagation of the pressure and the direction of growth of the air bubble can be efficiently controlled in conformity with the magnitude of the propagating pressure.

FIG. 7 shows a state in which after the aforementioned film boiling, the air bubble 40 contracts and disappears due to a decrease in the internal pressure of the air bubble 40.

The movable member 31 so far displaced to the second position is returned to the initial position of FIG. 4 (the first position) by the negative pressure by the contraction of the air bubble 40 and the restoring force by the springiness of the movable member itself. Also, during the disappearance of the air bubble, in order to compensate for the contracted volume of the air bubble in the air bubble creating area 11 and to compensate for the volume of the discharged liquid, the liquid flows from the common liquid chamber side as indicated by flows $V_{D1}$ and $V_{D2}$ and from the discharge port 18 side as indicated by $V_C$.

While the operation of the movable member 31 and the liquid discharging operation accompanying the creation of the air bubble have been described above, the refill of the liquid in the liquid discharging head applied to the present invention will hereinafter be described in detail.

A liquid supply mechanism in the liquid discharging head applied to the present invention will be described in greater detail with reference to FIGS. 4 to 7.

When after the state of FIG. 6, the air bubble 40 has entered its disappearing process via the state of its maximum volume, a volume of liquid compensating for the volume which has disappeared flows from the discharge port 18 side of the first liquid flow path 14 and the common liquid chamber side of the second liquid flow paths 16 into the air bubble creating area 11.

In the prior art liquid flow path structure not having the movable member 31, the amount of liquid flowing from the discharge port side into the air bubble disappearing position and the amount of liquid flowing from the common liquid chamber thereinto are attributable to the magnitude of the flow resistance in a portion nearer to the discharge port and a portion nearer to the common liquid chamber than to the air bubble creating area (that is, are based on the flow path resistance and the inertia of the liquid). Thus, when the flow resistance on the side near the discharge port is small, much liquid flows from the discharge port side into the air bubble disappearing position and the amount of retreat of meniscus becomes great. Particularly, as an attempt is made to make the flow resistance on the side near the discharge port small to enhance discharge efficiency, the retreat of the meniscus M during the disappearance of the air bubble has become great and thus, the refill time has become long and this has hindered high-speed printing.

In contrast, in the present embodiment, provision is made of the movable member 31 and therefore, when the volume W of the air bubble 40 is made such that with the first position of the movable member 31 as the boundary, the upper side is defined as W1 and the air bubble creating area 11 side is defined as W2, the retreat of the meniscus in the discharge port 18 stops at a point of time whereat the movable member 31 has returned to its original position during the disappearance of the air bubble, and the liquid supply of the volume W2 left thereafter is done chiefly by the liquid supply from a flow $V_{D2}$ in the second liquid flow paths 16. Thereby, in contrast with the prior art wherein the amount corresponding to about a half of the volume W of the air bubble has been the amount of retreat of the meniscus, it has become possible to suppress the amount of retreat of the meniscus to about a half of W1, which is less than that.

Further, the liquid supply of the volume W2 can be forcibly done chiefly from the upstream side ($V_{D2}$) of the second liquid flow paths 16 along that surface of the movable member 31 which is adjacent to the heat generating member 2 by the utilization of the pressure during the disappearance of the air bubble and therefore, more rapid refill can be realized.

What is characteristic here is that when the refill using the pressure during the disappearance of the air bubble is done in the prior-art head, the vibration of the meniscus has become great and this has led to the deterioration of the quality of image, whereas in the high-speed refill in the present embodiment, the communication of the liquid on the discharge port side of the area of the first liquid flow paths 14 which is adjacent to the discharge port and the air bubble creating area 11 is suppressed by the movable member and therefore the vibration of the meniscus in the discharge port 18 can be made very small.

Thus, in the liquid discharging head applied to the present invention, high-speed refill is achieved by the forced refill to the air bubble creating area 11 through the liquid supply path 12 of the second liquid flow paths 16 and the above-described suppression of the retreat and vibration of the meniscus, whereby an improvement in the quality of image and high-speed recording can be realized when such liquid discharging head is used in the fields of the stabilization of discharge, high-speed repetitive discharge and recording.

The aforedescribed construction further has the following effective function. It is to suppress the propagation (back wave) of the pressure by the creation of the air bubble to the upstream side B. Much of the pressure by an air bubble on the common liquid chamber side (the upstream side B) among bubbles created on the heat generating member 2 has provided a force (back wave) which pushes the liquid back toward the upstream side B. This back wave has caused the pressure on the upstream side B, the amount of movement of the liquid thereby and the inertial force resulting from the movement of the liquid, and these have reduced the refill of the liquid into the liquid flow paths and have also hindered high-speed driving. In the liquid discharging head applied to the present invention, these actions to the upstream side B are first suppressed by the movable member 31 to thereby achieve a further improvement in the refill supply.

Further, in the liquid discharging head applied to the present invention, the second liquid flow paths 16 have a liquid supply path 12 having an inner wall substantially flatly leading (the surface of the heat generating member being not greatly depressed) to the heat generating member 2 upstream of the heat generating member 2. In such a case, the supply of the liquid to the air bubble creating area 11 and the surface of the heat generating member 2 is done as indicated by $V_{D2}$ along that surface of the movable member 31 which is near the air bubble creating area 11. Therefore, the stagnation of the liquid on the surface of the heat generating member 2 is suppressed and the deposition of gas dissolved in the liquid and so-called reseal air bubbles remaining without disappearing are readily removed, and it never happens that the heat reserve in the liquid becomes too high. Accordingly, stabler creation of an air bubble can be repetitively effected at high speed. While the present embodiment has been described as having the liquid supply path 12 having a substantially flat inner wall, this is not restrictive, but the liquid supply path can be one smoothly leading to the surface of the heat generating member 2 and having a smooth inner wall, and can be of a shape which will not cause the stagnation of the liquid on the heat generating member and a great turbulence to the supply of the liquid.

Now, as regards the positions of the free end 32 and fulcrum 33 of the movable member 31, the free end 32 is downstream of the fulcrum 33 relative to the latter, as shown, for example, in FIG. 2. Because of such a construction, the function and effect of turning the direction of propagation of the pressure and the direction of growth of the air bubble to the discharge port side during the afore-described bubbling can be realized efficiently. Further, such positional relation not only can achieve the function and effect to discharge, but also can make the flow resistance to the liquid flowing through the liquid flow paths small during the supply of the liquid, thus achieving the effect that refill can be accomplished at high speed. This is because as shown in FIG. 6, the free end 32 and fulcrum 33 are disposed so as not to oppose the flow of the liquid flowing through the liquid flow paths (including the first liquid flow paths 14 and the second liquid flow paths 16) when the meniscus M retreated by discharge is returned to the discharge port 18 by a capillary force or when the supply of the liquid is effected against the disappearance of the air bubble.

Also, the head applied to the present invention adopts a two-flow-path construction and can therefore make the discharge liquid and the bubbling liquid discrete from each other and can discharge the discharge liquid by the pressure created by the bubbling of the bubbling liquid. Therefore, even in the case of a high-viscosity liquid such as polyethylene ethanol in which it has been difficult for bubbling to take place sufficiently even if heat is applied thereto and a discharging force has been insufficient, this liquid is supplied to the first liquid flow paths and a liquid in which bubbling takes place well (about 1–2 cP of a mixture of ethanol:water=4:6) or a liquid of a low boiling point is supplied as the bubbling liquid to the second liquid flow paths, whereby the liquid can be discharged well.

Also, a liquid which will not cause a deposit such as scorching on the surface of the heat generating member even if it is subjected to heat may be chosen as the bubbling liquid, whereby bubbling can be stabilized and good discharge can be accomplished.

Also, in the case of a liquid weak to heating, if this liquid is supplied as the discharge liquid to the first liquid flow paths and a liquid which does not easily thermally change in quality and will bubble well is supplied by the second liquid flow paths, the liquid can be discharged without imparting thermal harm to the liquid weak to heating and moreover, at high discharge efficiency and with a high discharging force.

The present embodiment has an important function for further improving the operational effect obtained by the movable member. This important function has been found by finding out a new preferable condition when study has been made of the conditions of the liquids in the liquid flow paths spaced apart from each other by the movable member. This function is to give epock- making environment as the conditions of the liquid surrounding the movable member to thereby make the behavior of the movable member more reliable. Such a function will hereinafter be described with reference to FIGS. 4 and 5.

This important function is characterized by making the internal pressure of the first liquid flow paths 14 and the internal pressure of the second liquid flow paths 16 differ from each other as the case may be.

As previously described, the first liquid flow paths 14 and the second liquid flow paths 16 communicate with each other through only the slit 35 around the movable member 31. As shown in FIG. 4, the liquid in the first liquid flow paths 14, i.e., the discharge liquid, usually has its internal pressure (the water head pressure) set so that negative pressure may be applied to the discharge port 18 and the slit 35 so that the meniscus M in the discharge port 18 can be held. Likewise, the liquid in the second liquid flow paths 16, i.e., the bubbling liquid, has its internal pressure (the water head pressure) set so that the meniscus may be held in the slit 35. Both the bubbling liquid and the discharge liquid are kept at negative pressure and hold the meniscus by the slit 35, but if they are left as they are for a long time, one of the liquid may flow (diffuse) from the slit 35 into the liquid flow path adjacent thereto.

Particularly, when a liquid liable to create scorching by the heat of the heat generating member 2 must be used as the discharge liquid, if this discharge liquid flows into the second liquid flow paths 16, scorching will be liable to occur on the heat generating member 2, and if scorching occurs, stable discharge for recording will not be provided.

Figure 10:
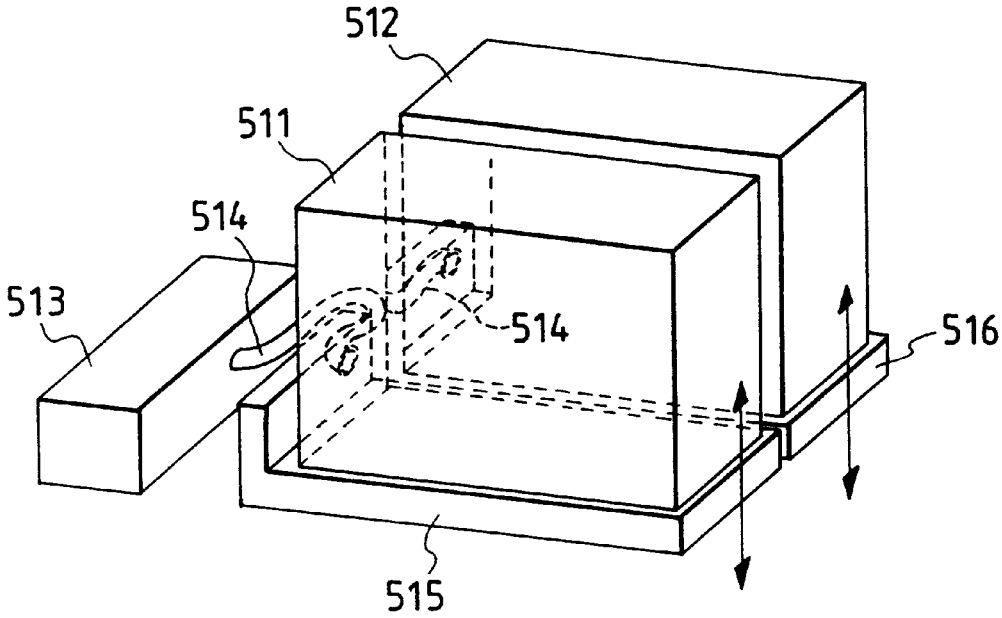
FIG. 10 is a perspective view showing an example of internal pressure control means used in the liquid discharging head of the present invention.

So, in the present embodiment, there is a function of setting the water head pressure of the bubbling liquid always at a higher level than the water head pressure of the discharge liquid to thereby prevent the discharge liquid from flowing into the second liquid flow paths 16 particularly during printing. An example of specific means therefor, i.e., internal pressure control means, is shown in FIG. 10.

This internal pressure control means 500 is comprised of tanks 511 and 512 storing the discharge liquid and the bubbling liquid, respectively, therein, tubes 514*a* and 514*b* for supplying the liquids in these tanks 511 and 512 to a head 513, and stages 515 and 516 for vertically moving the tanks 511 and 512, respectively, independently of each other. In this construction, by the vertically moving stages 515 and 516 being used, it becomes possible to change the level positions of the tanks 511 and 512, and the tubes 514*a* and 514*b* are given a length sufficient for the amounts of level displacement of the tanks 511 and 512. The vertically moving means for the tanks 511 and 512 is not particularly restricted, but as in the present embodiment, it can be realized by mounting the tanks 511 and 512 on the vertically moving stages 515 and 516 vertically movable by a driving motor.

The relative vertical position of the above-described vertically moving stages 515 and 516 is set so that the water head pressure on the bubbling liquid side may always be higher than the water head pressure on the discharge liquid side. Particularly during printing, heat is applied onto the heat generating member 2, and when the discharge liquid flows into the second liquid flow path 16 side, scorching will occur on the heat generating member 2 or discharge will become unstable or non-discharge will occur, depending on the composition of the discharge liquid. So, in the present embodiment, the water head pressure of the bubbling liquid during printing is made positive and the water head pressure of the discharge liquid is made negative so as to prevent the flow of the discharge liquid into the second liquid flow path 16 side. By the water head pressure of the bubbling liquid being thus made higher than the water head pressure of the discharge liquid, there arises the possibility of the bubbling liquid flowing into the first liquid flow path 14 side, but there is no problem because the bubbling liquid, if it flows into the discharge liquid, is small in quantity. Also, the internal pressure control means 500 is operated so as to provide that degree of pressure difference.

(Embodiment 2)

This embodiment is characterized in that high-viscosity ink is used as the discharge liquid and that the water head pressure of the first liquid flow paths 14 is set to a higher level than the water head pressure of the second liquid flow paths 16, and in the other constructions, i.e., the structure of the head and the construction of the internal pressure control means, etc., are similar to those in Embodiment 1.

When high-viscosity ink is used as the discharge liquid, the flow resistance of the discharge liquid is great and therefore, if the supply pressure (water head pressure) thereof is low, it is difficult to hold the meniscus M in the discharge port 18. As compared with this, the bubbling liquid is low in viscosity and readily flows in the flow paths. Accordingly, by making the supply pressure of the high-viscosity ink high, stable supply of the discharge liquid is always realized.

(Embodiment 3)

Figure 11:
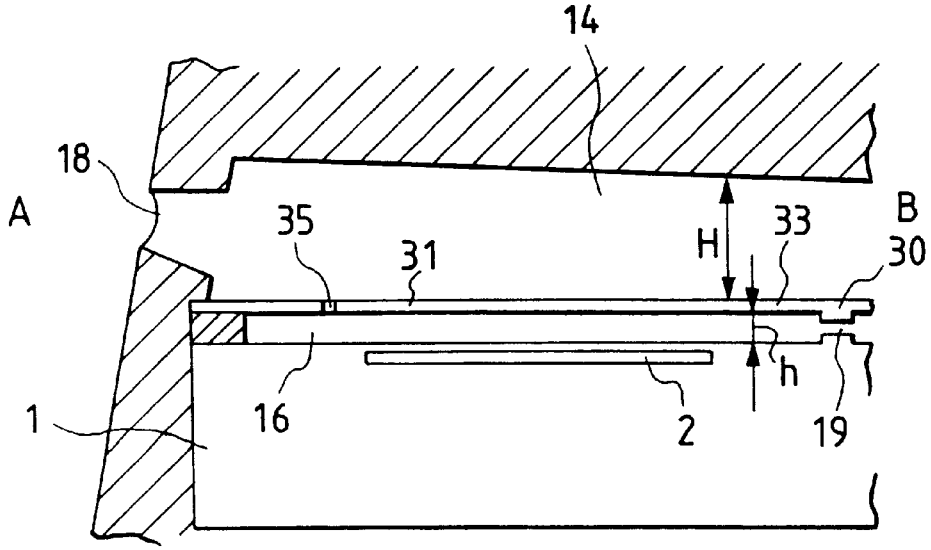
FIG. 11 is a schematic cross-sectional view showing an embodiment of the liquid discharging head of the present invention.

This embodiment is characterized in that as shown in FIG. 11, the height dimension h of the second liquid flow paths 16 is made smaller than the height dimension H of the first liquid flow paths 14, and a reduced portion 19 is formed on the upstream side of the second liquid flow paths 16 and further, the water head pressure of the second liquid flow paths 16 is set to a higher level than the water head pressure of the first liquid flow paths, and the other constructions, i.e., the structure of the head and the constructions of the internal pressure control means, etc., are similar to those in Embodiment 1.

According to this construction, the air bubble and expanding energy during bubbling are blocked on the upstream side B by the fluid element or reduced portion 19 and are efficiently converged toward the discharge port 18. As a result, the discharging performance (first-shot stability) at the start of recording is enhanced. Also, the water head pressure of the second liquid flow paths 16 is set to a high level and therefore, in spite of the pressure of the reduced portion 19, the refill of the bubbling liquid accompanying the disappearance of the air bubble can be suitably effected. The reduced portion 19 may be one reduced in the height direction of the flow paths as shown in FIG. 11, or one reduced in the widthwise direction of the flow paths as will be described.

(Embodiment 4)

This embodiment is characterized in that provision is made of temperature detecting means (not shown) for detecting the temperature in the head, and preferably the temperature in the first liquid flow paths 14, and the water head pressure in each of the liquid flow paths 14 and 16 is set in conformity with the temperature in the head measured by this temperature detecting means, and the other constructions, i.e., the structure of the head and the constructions of the internal pressure control means, etc. are similar to those in Embodiment 1.

Figure 12:
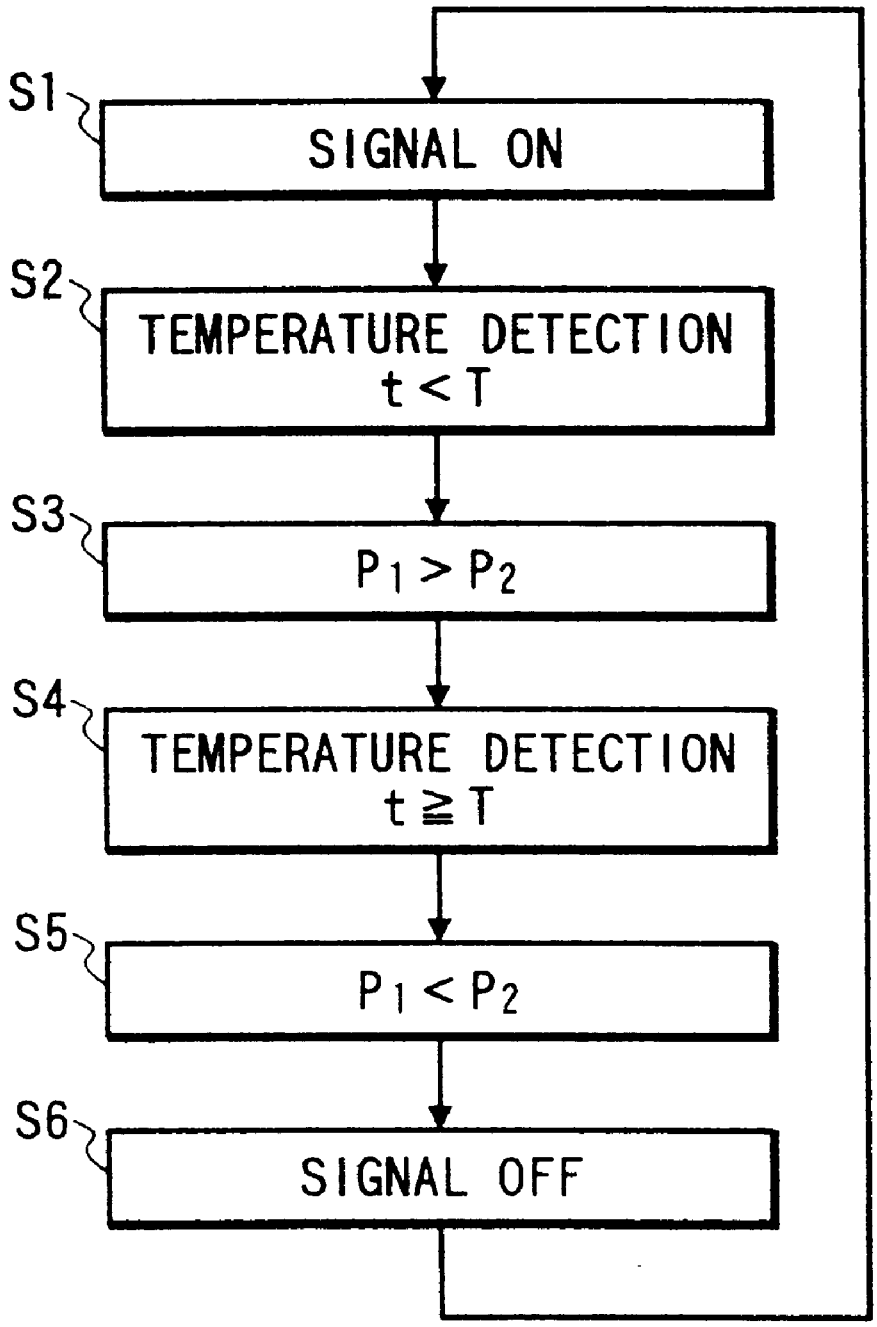
FIG. 12 is a control flow chart of an embodiment of the liquid discharging method of the present invention.

In the liquid discharging head, the heat generating member 2 is used as a drive source and therefore, the temperature of the liquid in the head changes with the lapse of time. There is also a case where the temperature of the liquid changes due to other factors. When a temperature change occurs, the viscosity of the liquid changes. The discharge liquid is relatively high in viscosity, and when the temperature thereof is low, the viscosity thereof becomes higher than the viscosity suitable for discharge. When the discharge liquid increases in viscosity, the first shot stability may sometimes become bad. So, as in the present embodiment, provision is made of the temperature detecting means for detecting the temperature preferably in the first liquid flow paths 14 and on the basis of the temperature information thereof, the relative water head pressure of the liquid flow paths is changed to thereby improve the first shot stability. Specifically, when the temperature t in the head has become equal to or less than the temperature T when the viscosity of the discharge liquid exceeds the limit of a proper value, the water head pressure $P_1$ of the first liquid flow paths 14 is set to a higher level than the water head pressure $P_2$ of the second liquid flow paths 16 by the internal pressure control means. In the other cases, $P_1<P_2$ is established so that the discharge liquid may not flow to the heat generating member 2 side. The control at this time will hereinafter be described with reference to a flow chart shown in FIG. 12. First, for example, the temperature detecting means is turned on in synchronism with the driving of the liquid discharging head to thereby detect the temperature in the first liquid flow paths 14 (S1). If the detected temperature (t) has become equal to or less than the temperature T when the viscosity of the discharge liquid exceeds the limit of the proper value (S2), the water head pressure $P_1$ of the first liquid flow paths 14 is set to a level equal to or higher than the water head pressure $P_2$ of the second liquid flow paths 16 (S3). Thereby, the first shot stability of the discharge liquid in a high viscosity state is improved. Next, when for example, with the continued use of the liquid discharging head, the detected temperature (t) has become equal to or higher than the aforementioned temperature T (S4), the water head pressure $P_1$ of the first liquid flow paths 14 is set to a lower level than the water head pressure $P_2$ of the second liquid flow paths 16 (S5). Thereby, the discharge liquid decreased in viscosity is prevented from flowing to the heat generating member 2 side to thereby cause the creation of scorching on the heat generating member 2 which will reduce the discharging force. Thereafter, in synchronism with the termination of the driving of the head, the temperature detecting means becomes OFF (S6). Next, when the head is again driven, the aforedescribed series of control operations are repeated.

(Embodiment 5)

Figure 13:
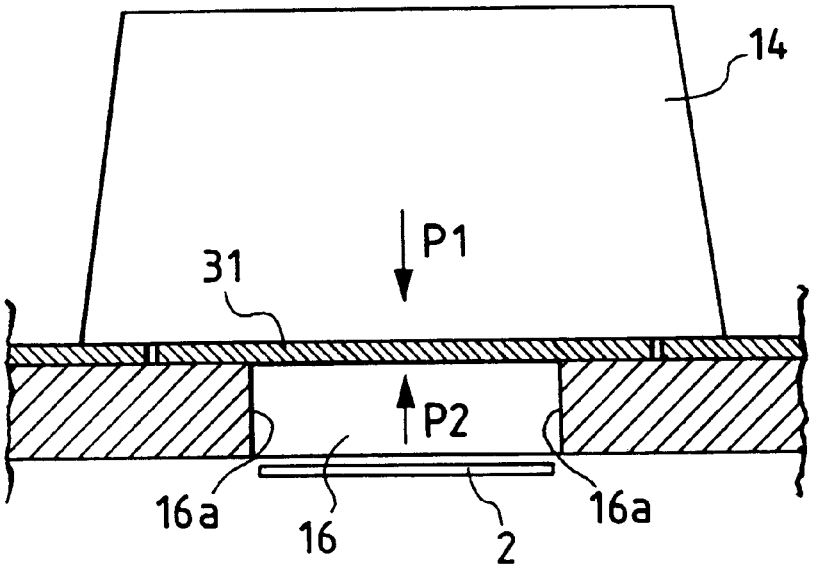
FIG. 13 is a schematic cross-sectional view of the essential portions of another embodiment of the liquid discharging head of the present invention.

This embodiment is characterized in that as shown in FIG. 13, the spacing between the opposite side walls 16*a* and 16*a* of the second liquid flow path 16 is narrowed in the projection area of the movable member 31 and that wall portion (not shown) of the second liquid flow path 16 which is situated at the end of the movable side of the movable member 31 juts out toward the movable member 31 side and that in such construction, the internal pressure $P_1$ of the first liquid flow path 14 is set to a higher level than the internal pressure $P_2$ of the second liquid flow path 16, and the other constructions, i.e., the structure of the head and the constructions of the internal pressure control means, etc. are similar to those in Embodiment 1.

Figure 14:
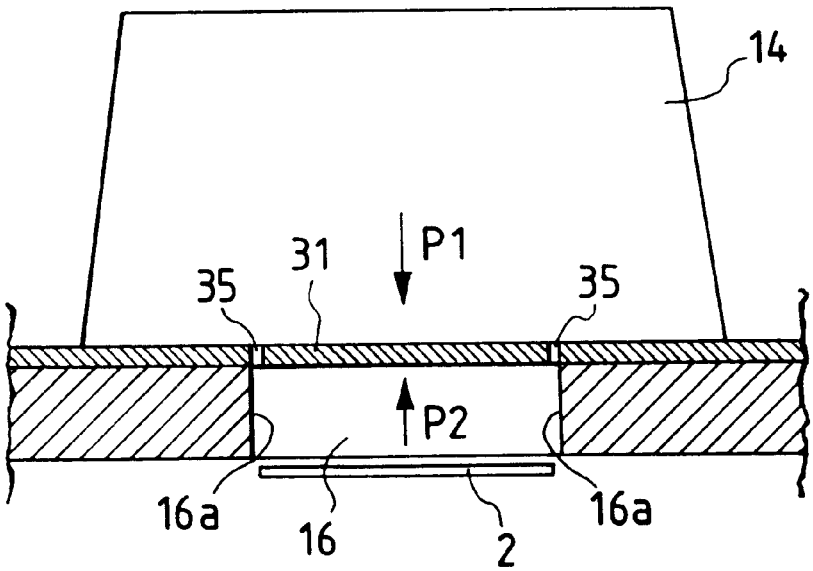
FIG. 14 is a schematic cross-sectional view showing an embodiment of the liquid discharging head of the present invention.

In the aforedescribed Embodiment 1, as shown in FIG. 14, the slit 35 is present between the movable member 31 spacing the first liquid flow path 14 and the second liquid flow path 16 apart from each other and the side wall 16*a* around it, and the first liquid flow path 14 and the second liquid flow path 16 communicate with each other through this slit 35. Herein, this state has been expressed as being substantially hermetically sealed. As described in Embodiment 1, in this state, the meniscus is held by the slit 35, but if the head is left as it is for a long time, one liquid may flow (diffuse) from the slit 35 into the liquid flow path adjacent thereto. Particularly, when a liquid liable to cause scorching by the heat of the heat generating member 2 must be used as the discharge liquid, if this discharge liquid flows into the second liquid flow path 16 side, scorching is liable to occur on the heat generating member 2, and when scorching occurs, stable discharge for recording becomes unobtainable. So, in the aforedescribed Embodiment 1, the internal pressure of the bubbling liquid is always set to a higher level than the internal pressure of the discharge liquid, whereby particularly during printing, the discharge liquid is prevented from flowing into the second liquid flow path 16 side on which the heat generating member 2 is present.

In contrast, in Embodiment 5, the movable member 31 being in its non-driven state is in close contact with the side wall 16*a* of the second liquid flow path 16 and moreover, the internal pressure $P_1$ of the first liquid flow path 14 is set to the internal pressure $P_2$ of the second liquid flow path 16. Accordingly, even in a state in which the head is left as it is for a long time, the movable member 31 continues to be in close contact with the side wall 16*a* which performs the role of the stopper of the second liquid flow path 16, and completely hermetically seals the space between the first liquid flow path 14 and the second liquid flow path 16 and thus, it reliably prevents the discharge liquid from flowing to the heat generating member 2 side when the head is left as it is.

In the aforedescribed embodiments, a mechanism for controlling the water head pressure has been described as the internal pressure control means, but as other mechanism, there can be adopted a construction in which a pump is provided in each liquid supply flow path and the internal pressure of each liquid flow path is controlled by the pump.

Figure 15A:
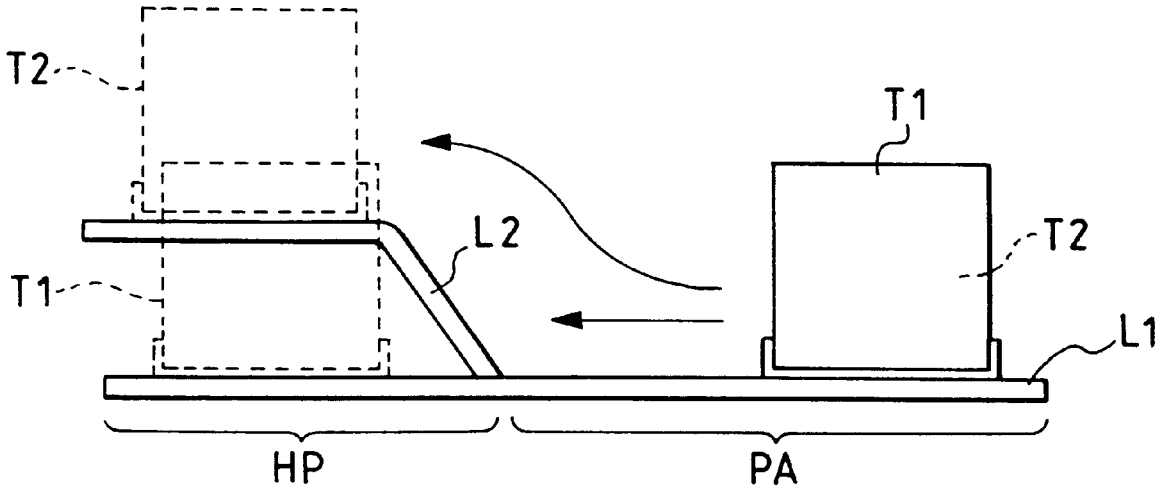
FIGS. 15A and 15B are schematic views showing an example in which the internal pressure of each liquid flow path in the liquid discharging head of the present invention is changed by a change in the horizontal position of a liquid container, FIG. 15A being a schematic front view, and FIG. 15B being a schematic plan view.
Figure 15B:
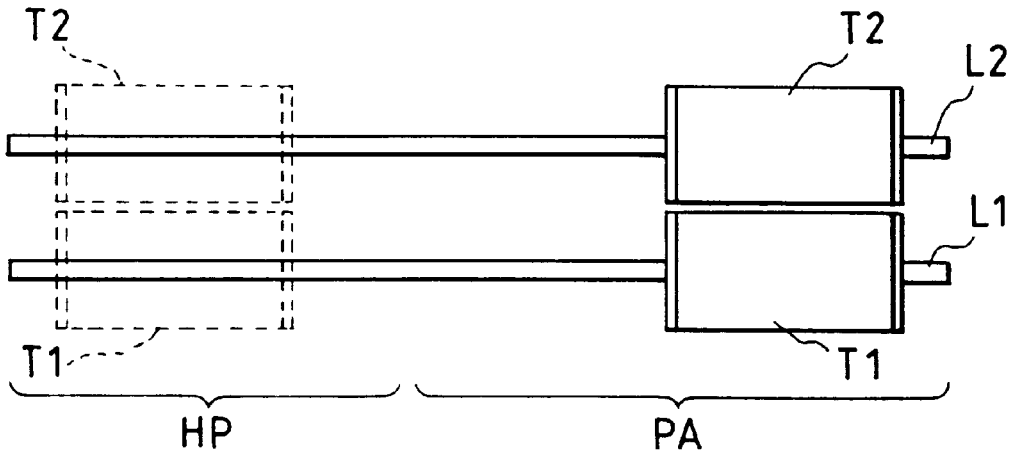

Also, in the aforedescribed construction, when it is necessary to change the supply pressure (internal pressure) of each liquid when the head is left as it is and when the head is driven, the vertical positions of the tanks can be changed with the movement of a carriage for moving the head. For example, as shown in FIGS. 15A and 15B, there may be adopted a construction in which respective liquid containers (tanks) T1 and T2 are connected to rails L1 and L2, respectively, and the levels of the rails L1 and L2 differ between the home position HP and a printing area PA so that the levels of the liquid containers T1 and T2 may be changed by the driving of the carriage connected thereto.

(Embodiment 6)

This Embodiment 6 and the following embodiments 7 and 8 are illustrated with respect to a liquid container (tank) for making the internal pressure of the first liquid flow path of the liquid discharging head and the internal pressure of the second liquid flow path differ from each other as previously described.

Figure 16:
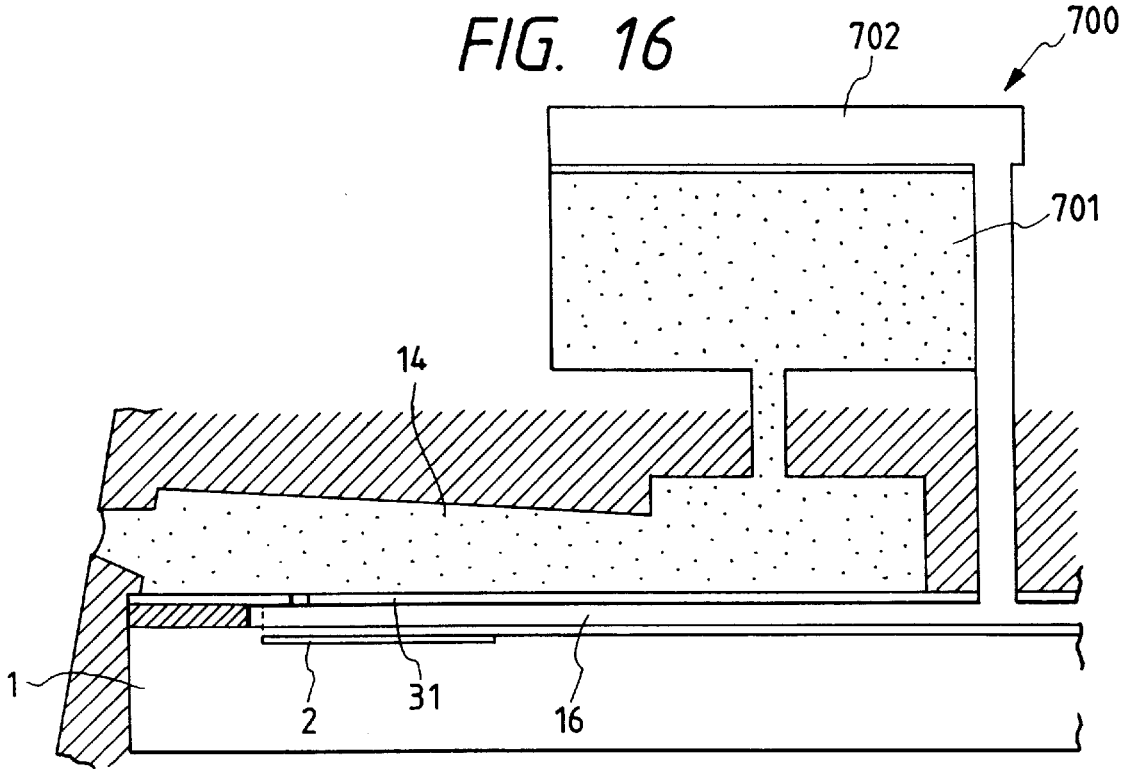
FIG. 16 is a schematic cross-sectional view showing a case where a liquid container for making the internal pressures of the respective liquid flow paths of the liquid discharging head differ from each other is provided integrally with the liquid discharging head.

As shown in FIG. 16, the liquid container 700 of this Embodiment 6 is comprised of a first containing portion 701 and a second containing portion 702 vertically integrally connected together, and is integrally installed on the aforedescribed liquid discharging head. The first containing portion 701 is connected to the first liquid flow path 14 of the liquid discharging head, and stores the discharge liquid therein. Also, the second containing portion 702 is connected to the second liquid flow path 16 of the liquid discharging head, and stores the bubbling liquid therein.

In this figure, the second containing portion 702 is situated on the first containing portion 701, and corresponds to a case where the condition that the water head pressure $P_2$ of the liquid (bubbling liquid) in the second liquid flow path 16 is greater than the water head pressure $P_1$ of the liquid (discharge liquid) in the first liquid flow path 14 is fixedly realized. However, a negative pressure difference may be created not only by the vertical positional relation between the first containing portion and the second containing portion, but also by the difference in size between the two containing portions. When it is desired to set the water head pressure oppositely, the vertical positions of the first containing portion 701 and the second containing portion 702 can be set oppositely. The form of FIG. 16 constitutes an ink cartridge in which the liquid discharging head and the liquid container are formed integrally with each other.

(Embodiment 7)

Figure 17:
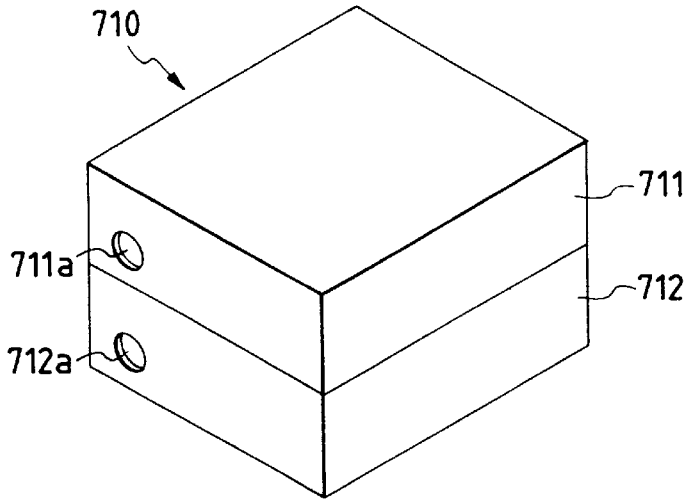
FIG. 17 is a perspective view of a liquid container of a form which is discrete from the liquid discharging head and creates an internal pressure difference by the difference in horizontal position between containing portions for respective liquids.

A liquid container 710 shown in FIG. 17, unlike the aforedescribed Embodiment 6, is one which is installed discretely from the liquid discharging head, and a first containing portion 711 and a second containing portion 712 are vertically integrally disposed. In this liquid container 710, the respective containing portions 711 and 712 are formed with connection ports 711*a* and 712*a*, respectively, which communicate with the respective liquid flow paths of the liquid discharging head through tubes. In this container 710, the two containing portions are vertically disposed to thereby make the pressure of the liquid in one liquid flow path and the pressure of the liquid in the other liquid flow path communicating with said one liquid flow path differ from each other.

(Embodiment 8)

Figure 18:
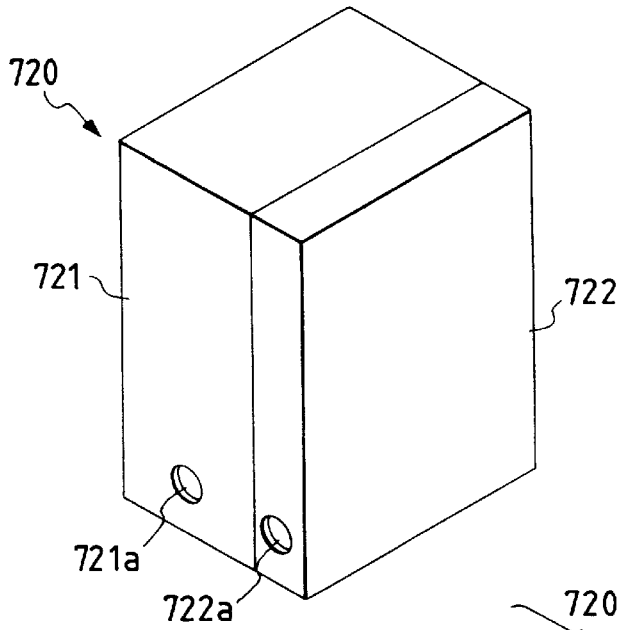
FIG. 18 is a perspective view of a liquid container of a form which is discrete from the liquid discharging head and creates an internal pressure difference by the difference in stock amount between containing portions for respective liquids.

A liquid container 720 shown in FIG. 18, also unlike the aforedescribed Embodiment 6, is one which is installed discretely from the liquid discharging head, and a first containing portion 721 and a second containing portion 722 are integrally disposed at the same horizontal position, and the content volumes thereof differ from each other. In the figure, the content volume of the first containing portion 721 is greater than the content volume of the second containing portion 722. In this liquid container 720, the respective containing portions 721 and 722 are formed with connection ports 721*a* and 722*a*, respectively, which communicate with the respective liquid flow paths of the liquid discharging head through tubes. In this container 720, the quantities of liquid stored in the respective containing portions are made to differ from each other to thereby make the pressure of the liquid in one liquid flow path and the pressure of the liquid in the other liquid flow path communicating with said one liquid flow path differ from each other.

(Embodiment 9)

Figure 19:
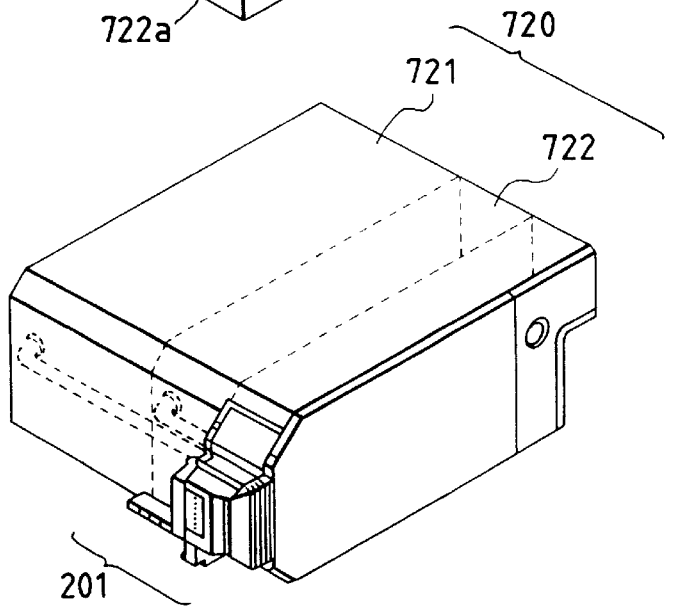
FIG. 19 is a perspective view of a head cartridge in which the liquid containers of the form of FIG. 18 are integrally assembled to the liquid discharging head.

FIG. 19 is a perspective view showing an example of a head cartridge according to the present invention. In this head cartridge, the liquid container 720 in the form described in Embodiment 8 is integrally assembled to a liquid discharging head 201.

<Other Embodiments>

Some embodiments of the essential portions of the liquid discharging head and liquid discharging method of the present invention have been described above, and embodiments preferably applicable to these embodiments will hereinafter be described with reference to the drawings. In the following description, however, there will be a case where one of the embodiment of the aforedescribed one-flow-path form and the embodiment of the two-flow-path form will be described, but unless specifically mentioned, the present invention is applicable to both embodiments.

<Shape of the Ceiling of the Liquid Flow Path>

Figure 20:
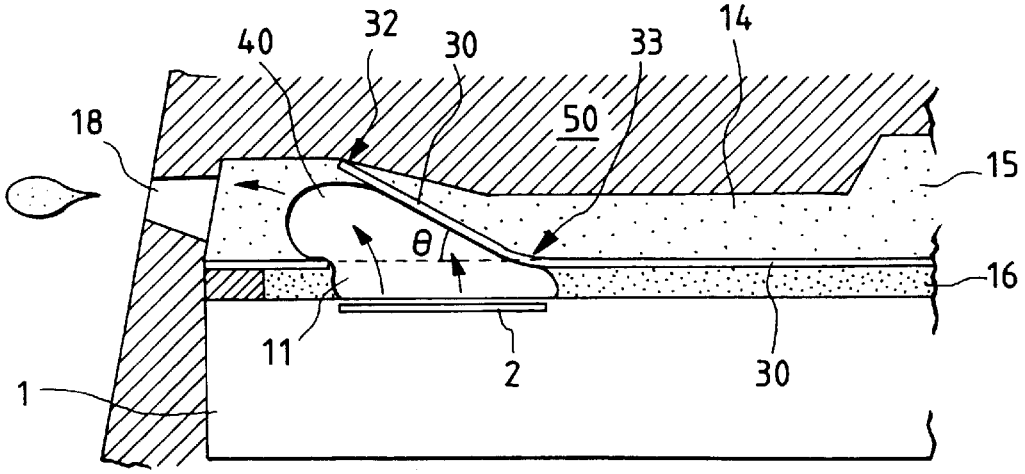
FIG. 20 is a view for illustrating the structure of a movable member and a first liquid flow path.

FIG. 20 is a cross-sectional view taken in the direction of the flow paths of the liquid discharging head of the present invention, and as shown there, a grooved member 50 formed with a groove for forming the first liquid flow path 14 is provided on the separating wall 30. In the present embodiment, the height of the ceiling of the flow path near the free end 32 of the movable member 31 is great so that the operation angle θ of the movable member 31 can be secured to a greater extent. This operation angle of the movable member can be determined with the structure of the liquid flow path, the durability and the air bubble creating force of the movable member 31, etc. taken into account, but it is considered to be desirable that the movable member operate up to an angle including the axial angle of the discharge port 18.

Also, as shown in this figure, the displacement height of the free end of the movable member 31 is made greater than the diameter of the discharge port 18, whereby the transmission of a sufficient discharging force is achieved. Also, as shown in this figure, the height of the ceiling of the liquid flow path at the location of the fulcrum 33 of the movable member 31 is lower than the height of the ceiling of the liquid flow path at the location of the free end 32 of the movable member 31 and therefore, the escape of the pressure wave to the upstream side by the displacement of the movable member 31 can be prevented more effectively.

<Disposition Relation between the Second Liquid Flow Path and the Movable Member>

Figure 21A:
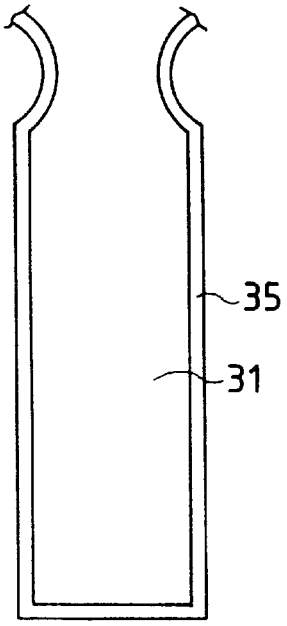
FIGS. 21A, 21B, and 21C are views for illustrating the structure of the movable member and the liquid flow path.
Figure 21B:
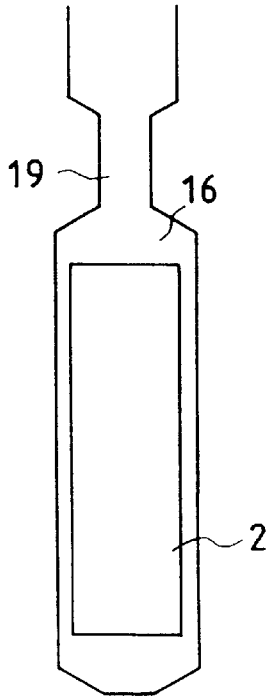
Figure 21C:
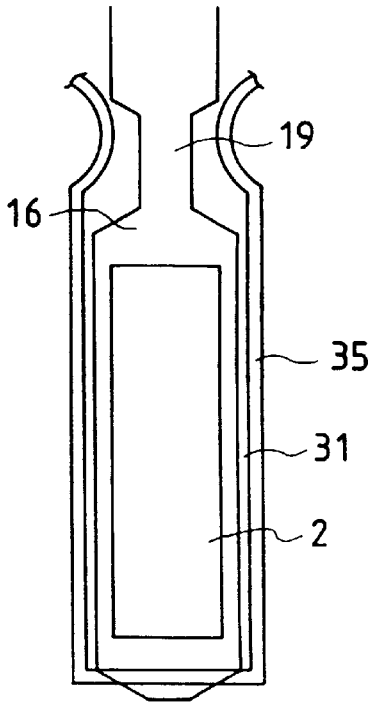

FIGS. 21A, 21B and 21C are views for illustrating the disposition relation between the movable member 31 and the second liquid flow path 16, FIG. 21A being a view of the vicinity of the separating wall 30 and movable member 31 as it is seen from above it, and FIG. 21B being a view of the second liquid flow path 16 with the separating wall 30 removed therefrom as it is seen from above it. FIG. 21C is a view schematically showing the disposition relation between the movable member 31 and the second liquid flow path 16 with these elements superposed one upon the other. In any of these figures, the lower side is the front side on which the discharge port is disposed.

The second liquid flow path 16 in the present embodiment has a reduced portion 19 on the upstream side of the heat generating member 2 (here the upstream side refers to the upstream side in a great flow from the second common liquid chamber side toward the discharge port via the location of the heat generating member, the movable member and the first flow path) and is of such chamber (air bubble creating chamber) structures that the pressure during bubbling is suppressed from easily escaping to the upstream side of the second liquid flow path 16.

In the case of a head like the prior-art head in which the flow path for creating an air bubble and the flow path for discharging the liquid are the same and a reduced portion is provided so that the pressure created on the liquid chamber side from the heat generating member may not escape to the common liquid chamber side, it has been necessary to adopt a construction in which the cross-sectional area of the flow path in the reduced portion is not very small, with the refill of the liquid fully taken into account.

In the case of the present embodiment, however, much of the discharged liquid can be made into the discharge liquid in the first liquid flow path so that the bubbling liquid in the second liquid flow path wherein the heat generating member is provided may not be much consumed and therefore, the refill amount of the bubbling liquid into the air bubble creating area 11 of the second liquid flow path may be small. Accordingly, the spacing in the above-mentioned reduced portion 19 can be made as narrow as several $\mu$m to several tens of $\mu$m and therefore, the escape of the pressure during bubbling created in the second liquid flow path to the surroundings can be further suppressed and such pressure can be concentratedly turned toward the movable member 31 side. This pressure can be utilized as the discharging force through the movable member 31 and thus, higher discharge efficiency and higher discharging force can be achieved. However, the shape of the first liquid flow path 14 is not restricted to the above-described structure, but may be any shape which will enable the pressure resulting from the creation of the air bubble to be effectively transmitted to the movable member 31 side. The relation between the construction having such a reduced portion 19 and the control of the internal pressure of the liquid flow paths 14 and 16 can be made such as described in the previous Embodiment 3 to thereby make the function of the movable member 31 more reliable.

As shown in FIG. 21C, the sideways portion of the movable member 31 covers a portion of the wall constituting the second liquid flow path, whereby the movable member 31 can be prevented from dropping into the second liquid flow path. Thereby, the separability of the discharge liquid and the bubbling liquid can be further enhanced. Also, the escape of the air bubble from the slit can be suppressed and therefore, the discharge pressure and discharge efficiency can be enhanced. Further, the effect of the refill from the upstream side by the pressure during the aforedescribed disappearance of the air bubble can be enhanced.

In FIGS. 5 and 20, a part of the air bubble created in the air bubble creating area of the second liquid flow path 16 with the displacement of the movable member 31 toward the first liquid flow path 14 side extends on the first liquid flow path 14 side, and by providing such height of the second flow path that the air bubble extends thus, the discharging force can be further improved as compared with a case where the air bubble does not extend. To permit the air bubble to extend thus in the first liquid flow path 14, it is desirable to make the height of the second liquid flow path 16 smaller than the height of the largest air bubble, and it is desirable that this height be several $\mu$m to 30 $\mu$m. In the present embodiment, this height is 15 $\mu$m.

<Movable Member and Separating Wall>

Figure 22A:
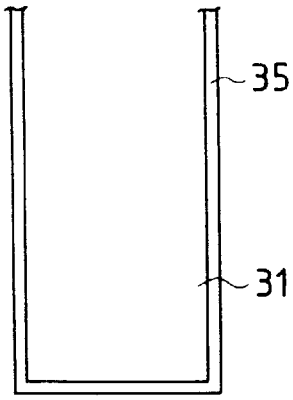
FIGS. 22A, 22B and 22C are views for illustrating other shapes of the movable member.
Figure 22B:
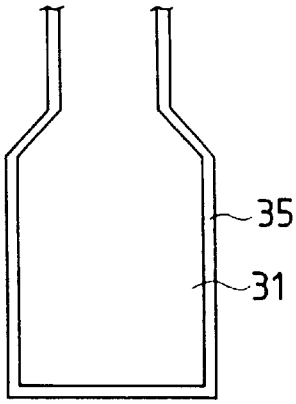
Figure 22C:
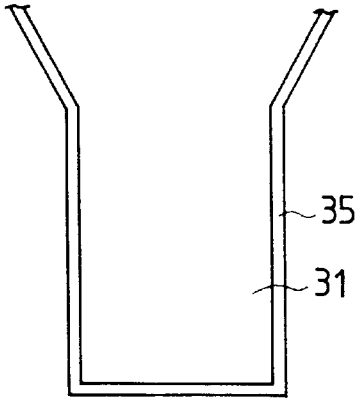

FIGS. 22A, 22B and 22C show other shapes of the movable member 31, and the reference numeral 35 designates a slit formed in the separating wall, and the movable member 31 is formed by this slit. FIG. 22A shows a rectangular shape, FIG. 22B shows a shape in which the fulcrum side is narrow and the movement of the movable member is easy, and FIG. 22C shows a shape in which the fulcrum side is wide and the durability of the movable member is improved. As a shape in which the ease of movement and the durability are good, the shape as shown in FIG. 21A wherein the width of the fulcrum side is arcuately narrow is desirable, but the shape of the movable member may be any shape in which the movable member does not come into the second liquid flow path side and is easily movable and is excellent in durability.

In the previous embodiment, the plate-like movable member 31 and the separating wall 5 having this movable member are formed of nickel having a thickness of 5 $\mu$m, whereas this is not restrictive, but the material forming the movable member and the separating wall may be any material having solvent resistance to the bubbling liquid and discharge liquid, having resiliency for operating well as the movable member, and permitting a minute slit to be formed therein.

The material of the movable member may desirably be a metal of high durability such as silver, nickel, gold, iron, titanium, aluminum, platinum, tantalum, stainless steel or phosphor bronze, or an alloy thereof, resin having a nitrile group such as acrylonitrile, butadiene or styrene, resin having an amide group such as polyamide, resin having a carboxyl group such as polycarbonate, resin having an aldehyde group such as polyacetal, resin having a sulfone group such as polysulfone, resin such as liquid crystal polymer or a compound thereof, a metal of high ink resistance such as gold, tungsten, tantalum, nickel, stainless steel or titanium, or an alloy thereof, a material having its surface coated with one of these regarding the ink resistance, resin having an amide group such as polyamide, resin having an aldehyde group such as polyacetal, resin having a ketone group such as polyether ether ketone, resin having an imide group such as polyimide, resin having a hydroxyl group such as phenol resin, resin having an ethyl group such as polyethylene, resin having an alkyl group such as polypropylene, resin having an epoxy group such as epoxy resin, resin having an amino group such as melamine resin, resin having a methylol group such as xylene resin or a compound thereof, ceramics such as silicon dioxide or a compound thereof.

The material of the separating wall may desirably be resin good in heat resistance, solvent resistance and moldability typified by recent engineering plastic such as polyethylene, polypropylene, polyamide, polyethylene terephthalate, melamine resin, phenol resin, epoxy resin, polybutadine, polyurethane, polyether ether ketone, polyether sulfone, polyacrylate, polyimide, polysulfone or liquid crystal polymer (LCP), or a compound thereof, or silicon dioxide, silicon nitride, a metal such as nickel, gold or stainless steel, or an alloy thereof or a compound thereof, or a material having its surface coated with titanium or gold.

Also, the thickness of the separating wall can be determined with the material, shape, etc. thereof taken into account from the viewpoint that the strength as the separating wall can be achieved and the separating wall operates well as the movable member, and may desirably be of the order of 0.5 μm–10 μm.

The movable member in the present invention is intended to have a thickness (t μm) of the μm order and is not intended as a movable member having a thhickness of the cm order. To a movable member having a thickness of the μm order, it is desirable to consider the irregularity of manufacture to a certain degree when a slit width (W μm) of the μm order is the subject.

When the thickness of the free end of the movable member forming the slit or/and the member opposed to the end side is equal to the thickness of the movable member (FIGS. 4, 5 and 20), the relation between the slit width and the thickness is made to fall within the following range with the irregularity of manufacture taken into account, whereby the mixing of the bubbling liquid and the discharge liquid can be stably suppressed. This has provided a construction in which although under limited conditions, when from the viewpoint of design, high-viscosity ink (5 cP, 10 cP or the like) is used relative to the bubbling liquid of viscosity of 3 cP or less, $W/t \leqq 1$ is satisfied, whereby it is possible to suppress the mixing of the two liquids for a long period of time.

As the slit which provides the "substantially hermetically sealed state" of the present invention, it will be more reliable if it is of such order of several μm.

<Element Substrate>

Description will hereinafter be made of the construction of the element substrate on which the heat generating member for giving heat to the liquid is provided.

Figure 23A:
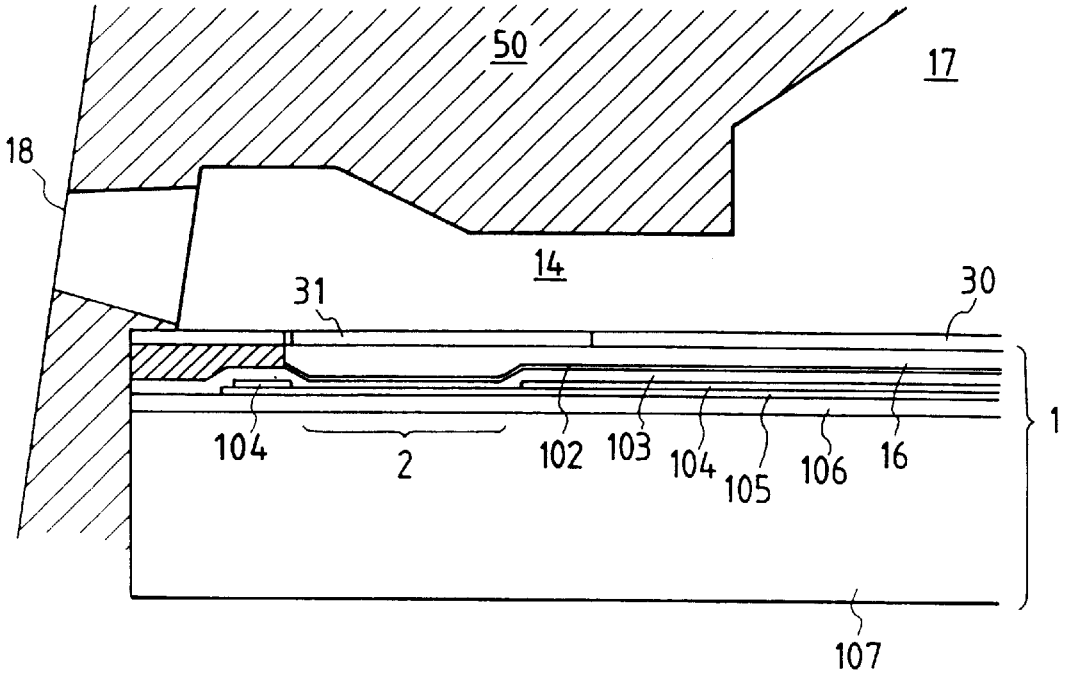
FIGS. 23A and 23B are longitudinal cross-sectional views of liquid discharging heads applied to the present invention.
Figure 23B:
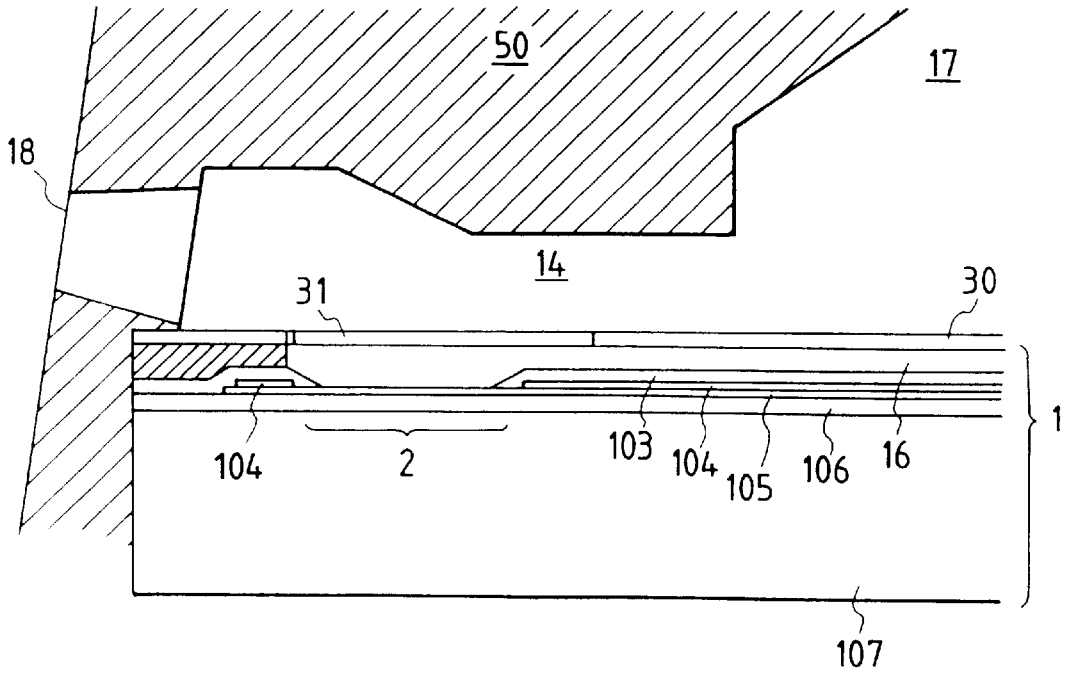

FIGS. 23A and 23B are longitudinal cross-sectional views of the liquid discharging heads of the present invention, FIG. 23A showing a head having protective film which will be described later, and FIG. 23B showing a head not having the protective film.

On the element substrate 1, there are disposed the second liquid flow path 16, the separating wall 30, the first liquid flow path 14 and a grooved member 50 formed with a groove constituting the first liquid flow path.

On the element substrate 1, silicon oxide film or silicon nitride film 106 intended for insulation and heat accumulation is formed in the gas 107 of silicon or the like, and an electrical resistance layer 105 (having a thickness of 0.01–0.2 μm) such as hafnium boride ($HfB_2$), tantalum nitride (TaN) or tantalum aluminum (TaAl) and wiring electrodes (having a thickness of 0.2–1.0 μm) such as aluminum are patterned thereon as shown in FIG. 11. A voltage is applied from these two wiring electrodes 104 to the resistance layer 105 to thereby cause an electric current to flow in the resistance layer and generate heat. On the resistance layer between the wiring electrodes, a protective layer of silicon oxide, silicon nitride or the like is formed with a thickness of 0.1–2.0 μm, and a cavitation resisting layer of tantalum or the like (having a thickness of 0.1–0.6 μm) is further formed thereon and protects the resistance layer 105 from various liquids such as inks.

Particularly, the pressure and shock wave created during the creation and disappearance of the air bubble are very strong and remarkably reduce the durability of the oxide film which is hard and fragile and therefore, tantalum (Ta) or the like which is a metallic material is used as the cavitation resisting layer.

Also, depending on the combination of the liquids, the liquid flow path construction and the resistance material, a contraction which does not require the above-described protective layer will do, and an example thereof is shown in FIG. 23B. As the material of the resistance layer which does not require such a protective layer, mention may be made of an iridium-tantalum-alluminum alloy or the like.

Thus, the construction of the heat generating member in each of the aforedescribed embodiments may be provided by only the resistance layer (heat generating portion) between the electrodes, and may also be one including the protective layer for protecting the resistance layer.

In the present embodiment, as the heat generating member, use is made of one having a heat generating portion comprised of a resistance layer generating heat in response to an electrical signal, whereas this is not restrictive, but use may be made of any one which will cause the bubbling liquid to create an air bubble sufficient to discharge the discharge liquid. For example, the heat generating portion may be an opto-thermal converting member adapted to receive light such as a laser to thereby generate heat, or a heat generating member having a heat generating portion adapted to receive a high frequency to thereby generate heat.

In the above described element substrate 1, in addition to the electro-thermal converting member comprised of the resistance layer 105 constituting the heat generating portion and the wiring electrodes 104 for supplying an electrical signal to the resistance layer, a functional element such as a transistor, a diode, a latch or a shift register for selectively driving this electro-thermal converting member may be integrally made by a semiconductor manufacturing process.

Figure 24:
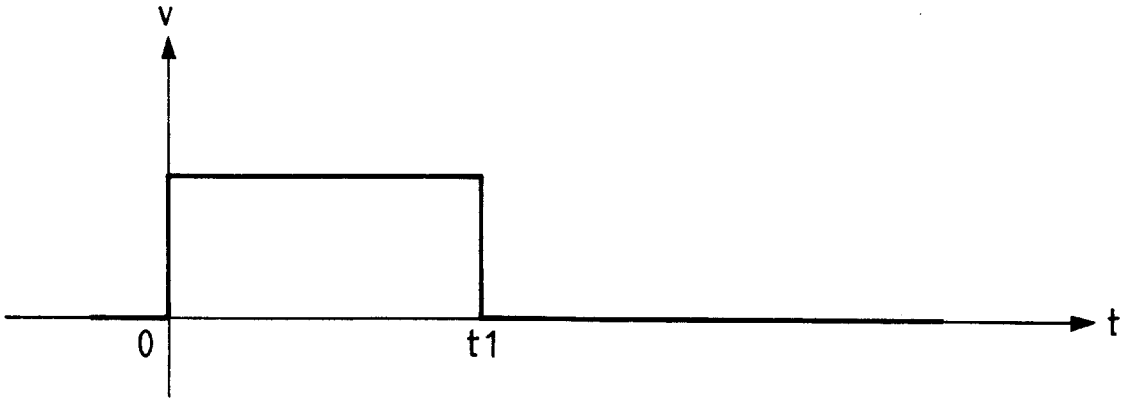
FIG. 24 is a model view showing the shape of a driving pulse.

To drive the heat generating portion of the electro-thermal converting member provided on the element substrate 1 as previously described to thereby discharge the liquid, a rectangular pulse as shown in FIG. 24 is applied to the aforedescribed resistance layer 105 through the wiring electrodes 104 to thereby cause the resistance layer 105 between the wiring electrodes to sharply generate heat. In the head of each of the aforedescribed embodiments, a voltage of 24V, a pulse width of 7 μsec., a current of 150 mA and an electrical signal of 6 kHz have been applied to thereby drive the heat generating member and by the operation as previously described, ink which is a liquid has been discharged from the discharge port. However, the conditions of the driving signal are not limited thereto, but use can be made of any driving signal which can cause the bubbling liquid to bubble properly.

<Head Structure of a Two-Flow-Path Construction>

Description will hereinafter be made of an example of the structure of a liquid discharging head in which different liquids can be well separated and introduced into first and second common liquid chambers and the number of parts can be curtailed to thereby reduce the cost.

Figure 25:
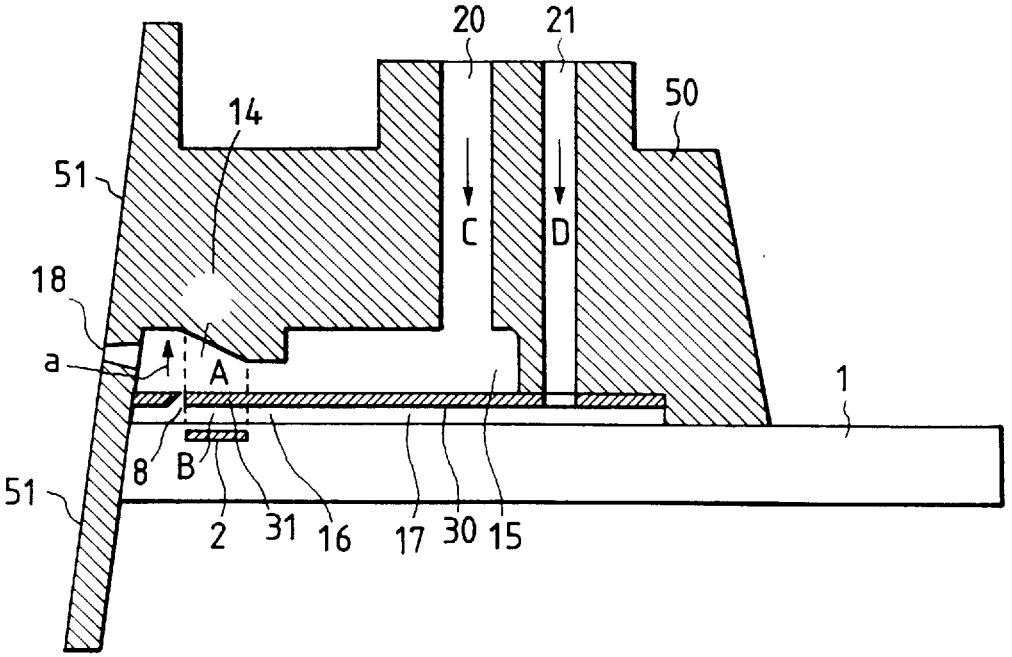
FIG. 25 is a cross-sectional view for illustrating the supply path of a liquid discharging head applied to the present invention.
Figure 26:
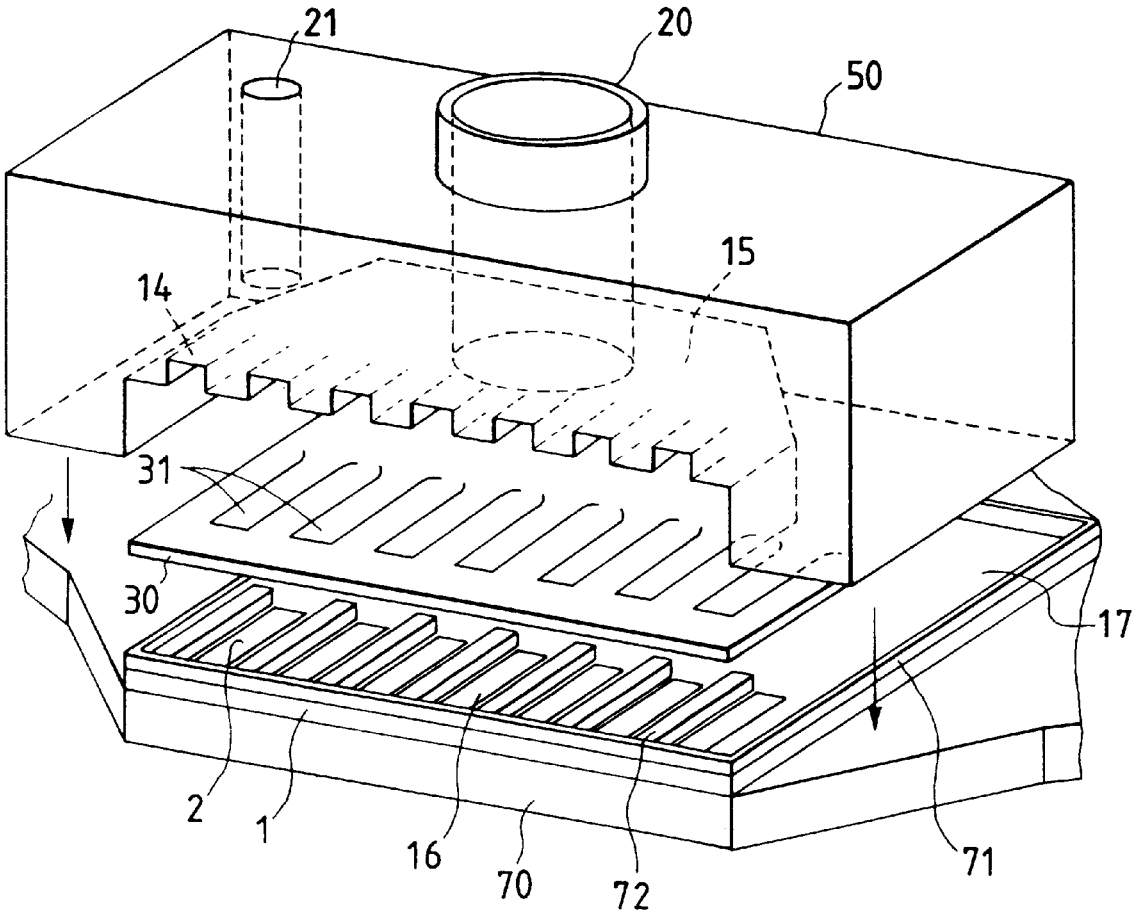
FIG. 26 is an exploded perspective view of the head applied to the present invention.

FIG. 25 is a schematic view showing the structure of such a liquid discharging head, and FIG. 26 is an exploded perspective view thereof (except an orifice plate), and in these figures, the same constituents as those in the previous embodiments are given the same reference numerals and need not be described in detail herein.

In the present embodiment, the grooved member 50 is generally comprised of an orifice plate 51 having a discharge port 18, a plurality of grooves constituting a plurality of first liquid flow paths 14, and a recess constituting a first common liquid chamber 15 communicating in common with the plurality of liquid flow paths 14 for supplying liquid (discharge liquid) to each first liquid flow path 3.

A separating wall 30 is joined to the lower portion of this grooved member 50, whereby the plurality of first liquid flow paths 14 can be formed. Such a grooved member 50 has a first liquid supply path 20 leading from the upper portion thereof into the first common liquid chamber 15. Also, the grooved member 50 has a second liquid supply path 21 leading from the upper portion thereof through the separating wall 30 into a second common liquid chamber 17.

Design is made such that a first liquid (discharge liquid), as indicated by an arrow C in FIG. 25, is supplied via the first liquid supply path 20 to the first common liquid chamber 15, and then to the first liquid flow paths 14, and a second liquid (bubbling liquid), as indicated by an arrow D, is supplied via the second liquid supply path 21 to the second common liquid chamber 17, and then to the second liquid flow path 16.

In the present embodiment, the second liquid supply path 21 is disposed parallel to the first liquid supply path 20, whereas this is not restrictive, but it may be disposed in any manner if it is formed so as to extend through the separating wall 30 disposed outside the first common liquid chamber 30 and communicate with the second common liquid chamber 17.

The thickness (diameter) of the second liquid supply path 21 is determined with the amount of supply of the second liquid taken into account. The shape of the second liquid supply path 21 need not be a round shape, but may be a rectangular shape or the like.

Also, the second common liquid chamber 17 can be formed by partioning the grooved member 50 by the separating wall 30. As a forming method, as shown in the exploded perspective view of FIG. 26 showing the present embodiment, a common liquid chamber frame and a second liquid path wall may be formed on the element substrate by dry film, and a coupled body of the grooved member 50 having the separating wall fixed thereto and the separating wall 30 may be attached to the element substrate 1 to thereby form the second common liquid chamber 17 and the second liquid flow path 16.

In the present embodiment, on a support member 70 formed of a metal such as aluminum, there is disposed the element substrate 1 on which there are provided a plurality of electro-thermal conversion elements as heat generating members generating heat for causing the bubbling liquid to create an air bubble by film boiling, as previously described.

On this element substrate 1, there are disposed a plurality of grooves constituting the liquid flow path 16 formed by the second liquid path wall, a recess constituting the second common liquid chamber (common bubbling liquid chamber) 17 communicating with a plurality of bubbling liquid flow paths for supplying the bubbling liquid to the respective bubbling liquid flow paths, and the separating wall 30 provided with the aforedescribed movable wall 31.

The reference numeral 50 designates the grooved member. This grooved member 50 is joined to separating wall 30 to thereby have a groove constituting the discharge liquid flow path (first liquid flow path) 14, a recess for constituting the first common liquid chamber (common discharge liquid chamber) 15 for supplying the discharge liquid to the respective discharge liquid flow paths, the first supply path (discharge liquid supply path) 20 for supplying the discharge liquid to the first common liquid chamber, and the second supply path (bubbling liquid supply path) 21 for supplying the bubbling liquid to the second common liquid chamber 17. The second supply path 21 leads to a communication path extending through the separating wall 30 disposed outside the first common liquid chamber 15 and communicating with the second common liquid chamber 17, and can supply the bubbling liquid to the second common liquid chamber 15 by this communication path without the bubbling liquid mixing with the discharge liquid.

The disposition relations among the element substrate 1, the separating wall 30 and the grooved top plate 50 are such that a movable member 31 is disposed correspondingly to the heat generating member on the element substrate 1 and the discharge liquid flow path 14 is disposed correspondingly to this movable member. Also, in the present embodiment, there is shown an example in which the second supply path is disposed in a grooved member, but a plurality of second supply paths may be provided in conformity with the amount of supply. Further, the flow path cross-sectional areas of the discharge liquid supply path 20 and the bubbling liquid supply path 21 can be determined in proportion to the amounts of supply.

It is also possible to make the parts constituting the grooved member 50, etc. small in size by such optimization of the flow path cross-sectional areas.

As described above, according to the present embodiment, the second supply path for supplying the second liquid to the second liquid flow path and the first supply path for supplying the first liquid to the first liquid flow paths comprise a grooved top plate as one and the same grooved member, whereby the number of parts can be curtailed and thus, the shortening of the steps of process and a reduction in costs become possible.

Also, due to such structure that the supply of the second liquid to the second common liquid chamber communicating with the second liquid flow path is done by the second liquid flow path in a direction going through the separating wall for separating the first liquid and the second liquid from each other, the step of attaching the separating wall, the grooved member and the heat generating member forming substrate to one another can be done only once and thus, the ease of making is improved and the attachment accuracy is also improved, and good discharge can be accomplished.

Also, the second liquid is supplied to the second common liquid chamber through the separating wall and therefore, the supply of the second liquid to the second liquid flow path becomes reliable and a sufficient amount of supply can be secured and thus, stable discharge becomes possible.

<Discharge Liquid and Bubbling Liquid>

As described with respect to the previous embodiment, in the present invention, by the construction having the movable member as previously described and the control of the relative value of the internal pressure of each liquid flow path, the liquid can be discharged with a higher discharging force and higher discharge efficiency and moreover at higher speed than in the prior-art liquid discharging head. When in the present embodiment, the same liquid is used as the bubbling liquid and the discharge liquid, the liquid is not deteriorated by the heat applied from the heat generating member and it is difficult for deposits to be produced on the heat generating member by heating and it is possible to effect the reversible state change of gasification and condensation by the heat and further, use can be made of various liquids which will not deteriorate the liquid flow paths, the movable member, the separating wall, etc.

Among such liquids, as the liquid used in recording (recording liquid), use can be made of ink of the composition used in conventional bubble jet apparatuses.

On the other hand, when the head of the two-flow-path construction of the present invention is used and the discharge liquid and the bubbling liquid are discrete liquids, the liquid of the nature as previously described can be used as the bubbling liquid and specifically, mention may be made of methanol, ethanol, n-propanol, isopropanol, n-hexane, n-heptane, n-octane, toluene, xylene, methylene dichloride, Trichlene, Freon TF, Freon BF, ethylether, dioxane, cyclohexane, methyl acetate, ethyl acetate, acetone, methyl ethyl ketone, water, etc. and a mixture thereof.

As the discharge liquid, use can be made of various liquids independently of the presence or absence of the bubbling property and the thermal property. Also, use can be made of a liquid of low bubbling property which has heretofore been difficult to discharge, a liquid liable to be changed or deteriorated in quality by heat, a high-viscosity liquid or the like.

However, it is desired that as the property of the discharge liquid, the discharge liquid itself be not a liquid which hampers the discharge and bubbling and the movement of the movable member by the reaction with the bubbling liquid.

As the discharge liquid for recording, utilization can also be made of high-viscosity ink or the like. As the other discharge liquids, utilization can also be made of liquids such as pharmaceticals and perfumes weak to heat.

In the present invention, recording was done with ink of the following composition used as recording liquid usable as both the discharge liquid and the bubbling liquid, but since the discharge speed of the ink became high due to an improvement in the discharging force, the shooting accuracy of liquid droplets was improved and very good recorded images could be obtained.

| Composition of Dye Ink (viscosity 2cp) | |
|---|---|
| (C.I. hood black 2) dye | 3% by weight |
| diethyleneglycol | 10% by weight |
| thiodiglycol | 5% by weight |
| ethanol | 5% by weight |
| water | 77% by weight |

Also, recording was done with liquids of the composition as shown below combined with the bubbling liquid and the discharge liquid and discharged. As a result, even a liquid of very high viscosity of 150 cp as well as a liquid of viscosity of ten and several CP which was difficult to discharge in the prior-art head could be discharged well and recorded images of high quality could be obtained.

| Composition of Bubbling Liquid 1 | |
|---|---|
| ethanol | 40% by weight |
| water | 60% by weight |
| **Composition of Bubbling Liquid 2** | |
| water | 100% by weight |
| **Composition of Bubbling Liquid 3** | |
| isopropyl alcohol | 10% by weight |
| water | 90% by weight |

-continued

| Composition of Discharge Liquid 1 Pigment Ink (Viscosity about 15cp) | |
|---|---|
| carbon black | 5% by weight |
| styrene-acrylic acid-acrylic acid ethyl copolymer (acid value 140, average molecular weight 8000) | 1% by weight |
| monoethanol amine | 0.25% by weight |
| glycerine | 69% by weight |
| thiodiglycol | 5% by weight |
| ethanol | 3% by weight |
| water | 16.75% by weight |
| **Composition of Discharge Liquid 2 (Viscosity 55cp)** | |
| Polyethylene glycol 200 | 100% by weight |
| **Composition of Discharge Liquid 3 (Viscosity 150cp)** | |
| Polyethylene glycol 600 | 100% by weight |

Now, in the case of the liquids which have heretofore been regarded as being difficult to discharge as previously described, the discharge speed was low and therefore, the irregularity of discharge directionality was promoted and the shooting accuracy of dots on recording paper was had and the irregularity of the amount of discharge by unstable discharge occurred, whereby it was difficult to obtain images of high quality. In the constructions of the above-described embodiments, however, the creation of the air bubble can be effected sufficiently and moreover stably by the use of the bubbling liquid. Thus, an improvement in the shooting accuracy of liquid droplets and the stabilization of the amount of ink discharge could be achieved and the quality of recorded images could be remarkably improved.

<Liquid Discharging Apparatus>

Figure 27:
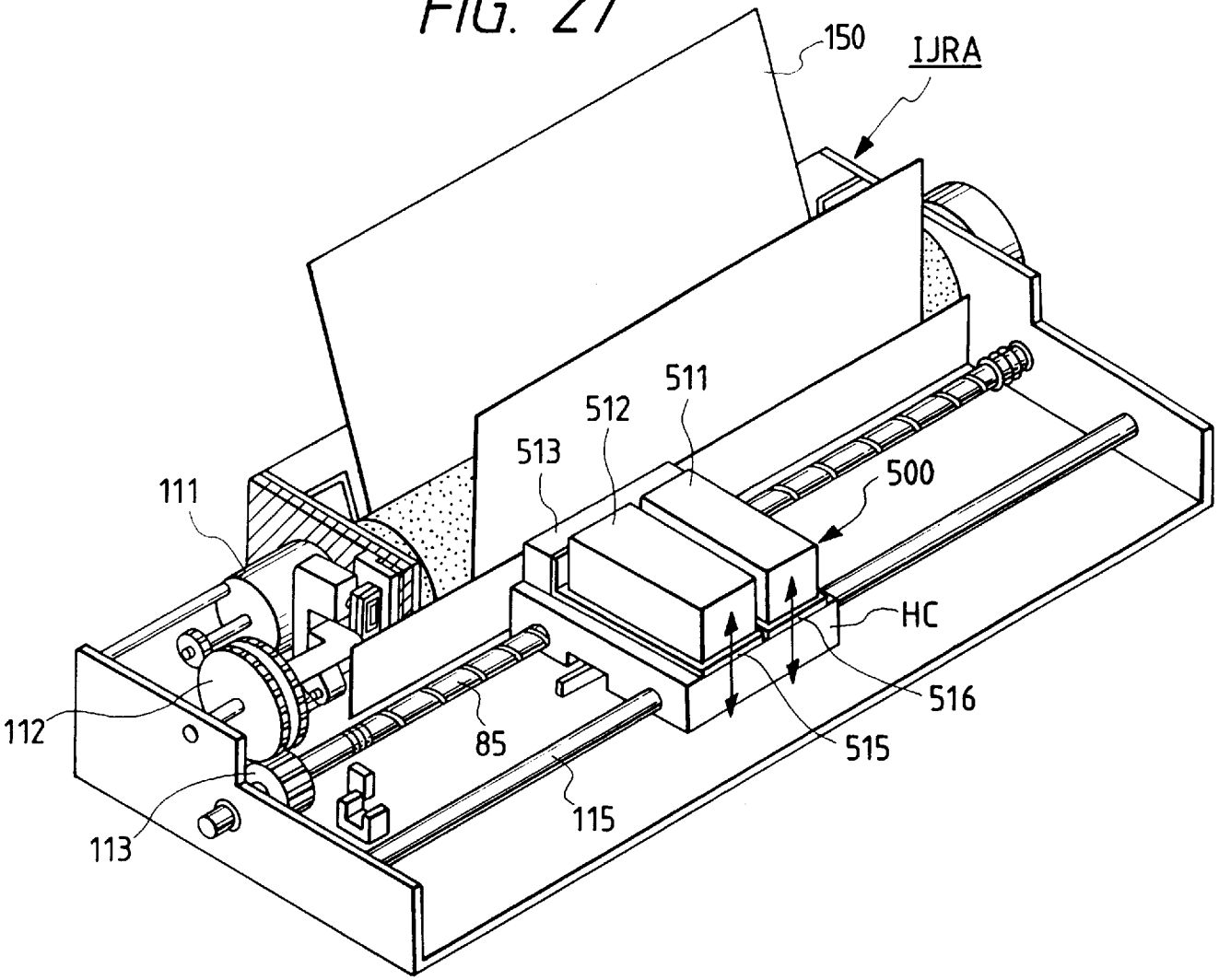
FIG. 27 is a perspective view of a liquid discharging apparatus.

FIG. 27 schematically shows the construction of a liquid discharging apparatus carrying the aforedescribed liquid discharging head thereon. In this embodiment, description will be made by the use of an ink discharge recording apparatus using particularly ink as the discharge liquid. The carriage HC of the liquid discharge recording apparatus carries the aforedescribed liquid discharging head 513 and internal pressure control means 500 thereon, and is reciprocally movable in the widthwise direction of a recording medium 150 such as recording paper conveyed by recording medium conveying means.

When a driving signal is supplied from driving signal supply means, not shown, to the liquid discharging means on the carriage, recording liquid is discharged from the liquid discharging head to the recording medium in response to this signal.

Also, the liquid discharging apparatus of the present embodiment has a motor 111 as a drive source for driving the recording medium conveying means and the carriage, gears 112 and 113 for transmitting the power from the drive source to the carriage, a carriage shaft 115, etc. By this recording apparatus and a liquid discharging method carried out by this recording apparatus, the liquid was discharged to various recording mediums, whereby good recorded images could be obtained.

Figure 28:
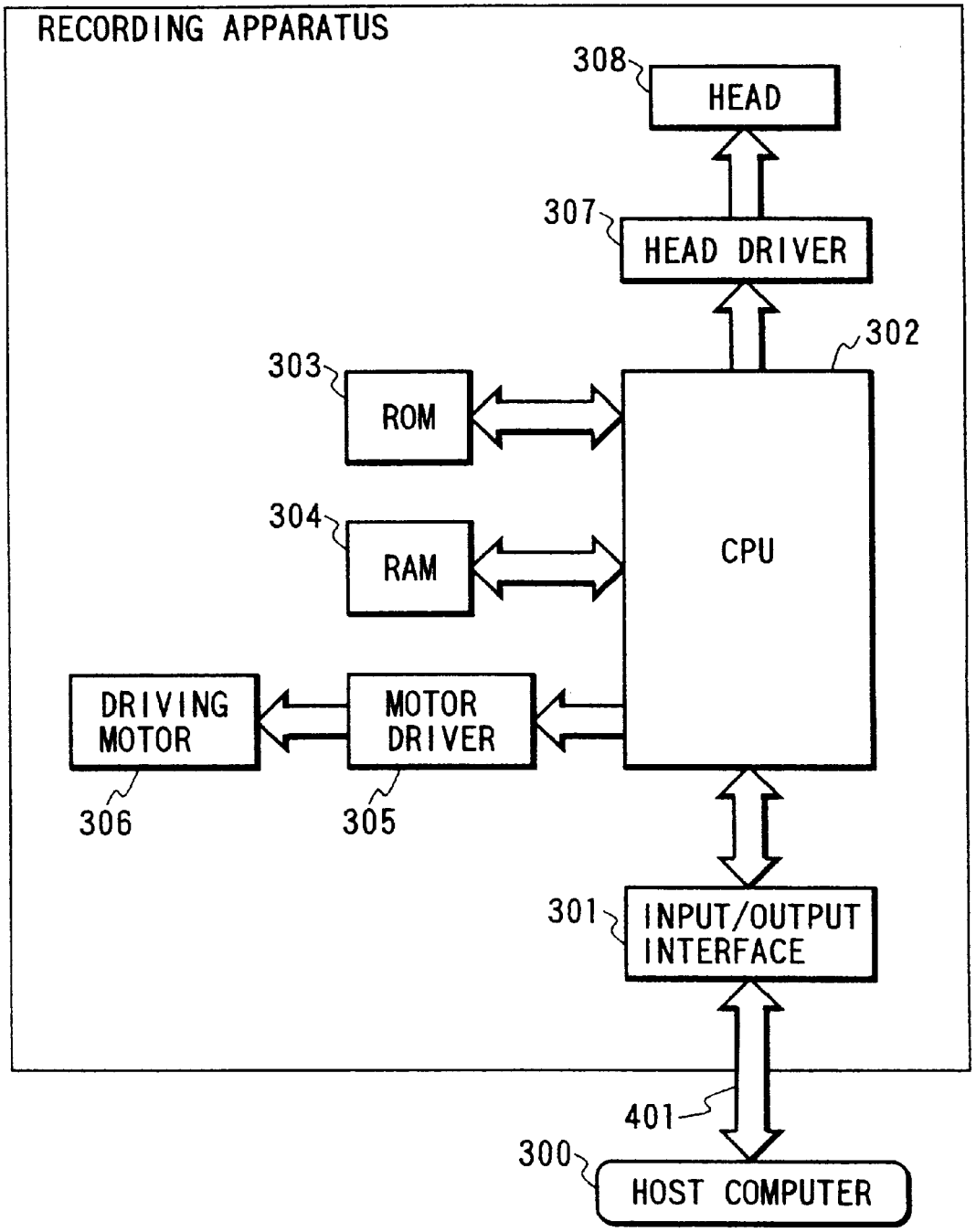
FIG. 28 is a block diagram of a liquid discharge recording apparatus.

FIG. 28 is a block diagram of the entire apparatus for effecting ink discharge recording to which the liquid discharging method and liquid discharging head of the present invention are applied.

The recording apparatus receives printing information as a control signal from a host computer 300. The printing information is temporarily preserved in an input interface 301 in the printing apparatus and at the same time, is converted into data which can be processed in the recording apparatus, and is inputted to a CPU 302 serving also as head driving signal supply means. The CPU 302 processes the data inputted thereto, by the use of a peripheral unit such as an RAM 304 on the basis of a control program preserved in an ROM 303, and converts the inputted data into data for printing (image data).

Also, the CPU 302 makes driving data for driving a drive motor for moving recording paper and the recording head in synchronism with the image data, in order to record the image data at a suitable location on the recording paper. The image data and the motor driving data are transmitted to a head 308 and a drive motor 306, respectively, through a head driver 307 and a motor driver 305, and the head and the drive motor are driven at controlled timing to thereby form an image.

Recording mediums applicable to the recording apparatus as described above and to which liquid such as ink is imparted include various kinds of paper and OHP sheets, plastic materials used in compact discs, decoration plates, etc, cloth, metallic materials such as aluminum and copper, leather materials such as oxhide, cowhide, pigskin and artificial leather, wood such as trees and plywood, ceramic materials such as tiles, and three-dimensional structures such as sponges.

Also, the above-described recording apparatuses include a printer apparatus for effecting recording on various kinds of paper, OHP sheets, etc., a recording apparatus for plastic for effecting recording on plastic materials such as compact discs, a recording apparatus for metal for effecting recording on metallic plates, a recording apparatus for leather for effecting recording on leather, a recording apparatus for wood for effecting recording on wood, a recording apparatus for ceramics for effecting recording on ceramic materials, a recording apparatus for effecting recording on three-dimensional net-like structures such as sponges, and a textile printing apparatus for effecting recording on cloth.

Also, the discharge liquids used in these liquid discharging apparatuses may be liquids conforming to respective recording mediums and recording conditions.

<Recording System>

Description will now be made of an example of an ink jet recording system for effecting recording on a recording medium by using the liquid discharging head of the present invention as a recording head.

Figure 29:
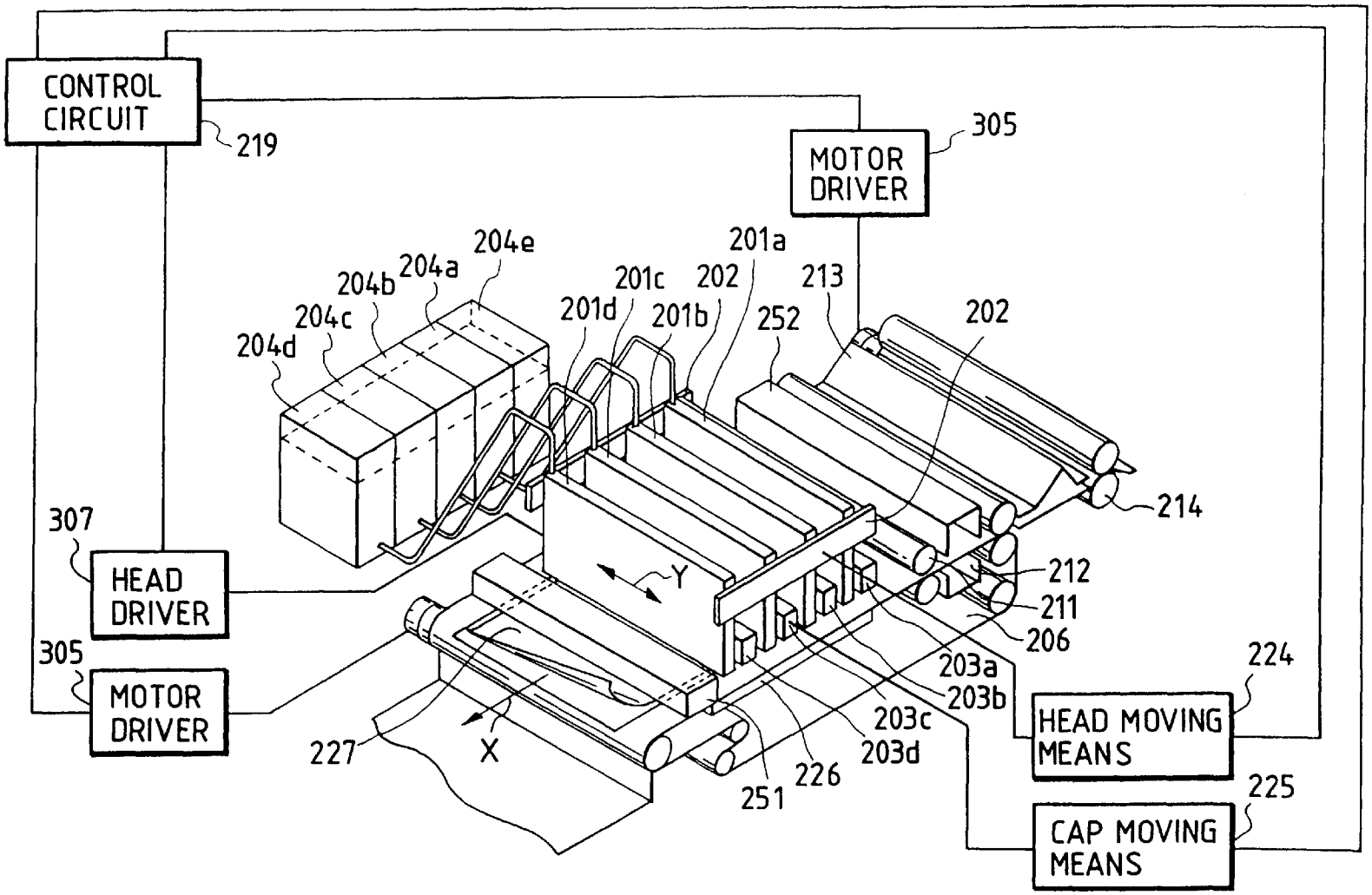
FIG. 29 shows a liquid discharge recording system.

FIG. 29 is a schematic view for illustrating the construction of the ink jet recording system using the aforedescribed liquid discharging head 201 of the present invention. The liquid discharging head in the present embodiment is a full line type head in which a plurality of discharge ports are disposed at intervals of 360 dpi over a length corresponding to the possible recording width of a recording medium 150, and comprises four heads corresponding to four colors, i.e., yellow (Y), magenta (M), cyan (C) and black (Bk) and fixedly supported in parallelism to one another at predetermined intervals in X direction by a holder 202.

A signal is supplied to these heads from a head driver 307 constituting driving signal supply means, and the driving of each head is done on the basis of this signal.

Inks of four colors, i.e., Y, M, C and Bk, as discharge liquids are supplied from respective ink containers 204*a*–204*d* to the respective heads. The reference character 204*e* designates a bubbling liquid container storing bubbling liquid therein, and the bubbling liquid may be supplied from this container to each head.

Also, below the respective heads, there are provided head caps 203*a*–203*d* in which ink absorbing members such as sponges are disposed, and these head caps cover the discharge ports of the respective heads during non-recording to thereby accomplish the maintenance of the heads.

The reference numeral 206 denotes a conveying belt constituting conveying means for conveying the various kinds of recording mediums as described in the previous embodiments. The conveying belt 206 is drawn around a predetermined route by various rollers, and is driven by a driving roller connected to a motor driver 305.

In the ink jet recording system of the present embodiment, a before processing apparatus 251 and an after processing apparatus 252 for effecting various processes on the recording medium before and after recording is effected are provided upstream and downstream, respectively, of the recording medium conveyance path.

The before processing and the after processing differing substance from each other in conformity with the kind of the recording medium and the kinds of the inks used in recording, but for example, to a recording medium such as a metal, plastic or ceramics, the application of ultraviolet rays and zones is done as the before processing to activate the surface thereof, whereby the adhering property of the inks can be improved. Also, in the case of a recording medium such as plastic liable to create static electricity, dust is liable to adhere to the surface thereof due to the static electricity and good recording may sometimes be hampered by the dust. Therefore, as the before processing, the static electricity of the recording medium may preferably be removed by the use of an ionizer apparatus to thereby remove the dust from the recording medium. Also, when cloth is used as the recording medium, the process of impacting to the cloth a substance selected from among an alkaline substance, a water-solvent substance, a synthetic high molecule, a water-solvent metallic salt, urea and thiourea may preferably be carried out as the before processing from the viewpoints of preventing oozing and improving the degree of exhaustion. The before processing is not restricted thereto, but may be the process of making the temperature of the recording medium into a temperature appropriate for recording.

On the other hand, the after processing is that which carries out the heat processing to the recording medium to which the inks have been imparted, the fixating process of expediting the fixation of the inks as by the application of ultraviolet rays, the process of washing the treating agent impacted in the before processing and left as it is unreacted, etc.

In the present embodiment, the head has been described as the full line head, whereas this is not restrictive, but the head may be of a type in which the small head as described above is conveyed in the widthwise direction of the recording medium to thereby effect recording.

According to the liquid discharging method, head, etc. of the present invention as described above based on the novel principle of discharge using a movable member, the combined effect of the created air bubble and the movable member displaced thereby can be obtained and the liquid near the discharge port can be efficiently discharged and therefore, the discharge efficiency can be improved as compared with the discharging method, head, etc. of the conventional bubble jet type.

Also, according to the characteristic construction of the present invention, i.e., the construction in which the internal pressure of the first liquid flow path and the internal pressure of the second liquid flow path spaced apart from each other by the movable member are made to differ from each other, the stable supply of high-viscosity ink is made possible and the refill of the liquid creating an air bubble can be improved, and the mixing of the upper and lower liquids vertically spaced apart from each other by the movable member during non-driving can be prevented and the discharge performance (called the first shot stability) at the start of recording can be improved, and the discharge liquid can be prevented from flowing to the heat generating member being driven beyond the movable member (as a result, it never happens that scorching occurs on the heat generating member with the lapse of time).

There is also the advantage that even if the apparatus is left under a low temperature and low humidity for a long period of time, non-discharge can be prevented and even if non-discharge occurs, the apparatus can be restored to its normal state on the spot by slightly carrying out a recovery process such as preliminary discharge or suction recovery. Along with this, the recovery time can be shortened and the loss of the liquid by the shortening or recovery can be reduced and thus, the running cost can also be greatly reduced.

Also, according to the construction of the present invention in which the refill characteristic is improved, it is possible to achieve the responsiveness, the stable growth of an air bubble and the stabilization of liquid droplets during continuous discharge to thereby make high-speed recording and high-quality image recording by high-speed liquid discharge possible.

Also, in the head of a two-flow-path construction, as the bubbling liquid, use is made of a liquid ready to bubble or a liquid in which it is difficult for deposits (such as scorching) on the heat generating member to be created, whereby the degree of freedom of the choice of the discharge liquid becomes higher and it becomes possible for even a liquid which has been difficult to discharge by the conventional bubble jet discharging method, such as a high-viscosity liquid difficult to bubble or a liquid liable to create deposits on the heat generating member to be discharged well.

Further, any liquid weak to heat can also be discharged without being adversely affected by heat.

Also, according to the method of manufacturing the liquid discharging head of the present invention, the liquid discharging head as described above can be manufactured with good accuracy, and can be manufactured inexpensively and moreover easily with the number of parts reduced.

Also, the liquid discharging head of the present invention can be used as a liquid discharge recording head for recording to thereby achieve recording of a higher image quality.

Also, the liquid discharging head of the present invention can be used to provide a liquid discharging apparatus, a recording system, etc. which are further improved in the discharge efficiency of liquid, etc.

What is claimed is:

1. A liquid discharging head comprising:

a discharge port for discharging a liquid;

a liquid flow path communicating with said discharge port;

a bubble generation area provided on said liquid flow path to generate a bubble in the liquid; and a movable member having a free end on the side of said discharge port, the free end being shiftable upon generation of the bubble in said bubble generation area, wherein said movable member has a fluid element upstream of said bubble generation area.

2. A liquid discharging head comprising:

a liquid chamber for supplying a liquid to be discharged;

a discharge port for discharging the liquid in said liquid chamber;

a liquid flow path communicating with said discharge port;

a bubble generation area provided on said liquid flow path to generate a bubble in the liquid; and a separation wall provided with a movable member having a free end on the side of said discharge port, the free end being shiftable upon generation of the bubble in said bubble generation area, wherein by said separation wall, said liquid flow path defines a first liquid flow path that directly communicates with said liquid chamber and said discharge port, and a second liquid flow path having said bubble generation area, and said separation wall has a protecting portion upstream of said bubble generation area, said projecting portion projecting toward said bubble generation area on a side of said bubble generation area of said separation wall.

* * * * *

UNITED STATES PATENT AND TRADEMARK OFFICE

CERTIFICATE OF CORRECTION

PATENT NO. : 6,142,613
DATED : November 7, 2000
INVENTOR(S) : Yoshie Asakawa, et al.

It is certified that error appears in the above-identified patent and that said Letters Patent is hereby corrected as shown below:

Column 1:
Line 62, "dignity" should read -- quality --.

Column 3:
Line 42, "are" should read -- is --.

Column 8:
Line 27, "an" should be deleted.

Column 21:
Line 9, "above it." should read -- above.--.

Column 23:
Line 18, "thhickness" should read -- thickness --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*